US011446931B2

(12) United States Patent
Lee

(10) Patent No.: US 11,446,931 B2
(45) Date of Patent: Sep. 20, 2022

(54) LIQUID CONSUMPTION APPARATUS

(71) Applicant: BROTHER KOGYO KABUSHIKI KAISHA, Nagoya (JP)

(72) Inventor: Tony Lee, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 20 days.

(21) Appl. No.: 17/035,864

(22) Filed: Sep. 29, 2020

(65) Prior Publication Data

US 2021/0016576 A1 Jan. 21, 2021

Related U.S. Application Data

(63) Continuation of application No. PCT/JP2018/043948, filed on Nov. 29, 2018.

(51) Int. Cl.
*B41J 2/175* (2006.01)
*B41J 29/38* (2006.01)

(52) U.S. Cl.
CPC ..... *B41J 2/17566* (2013.01); *B41J 29/38* (2013.01)

(58) Field of Classification Search
CPC ..... B41J 2/17563; B41J 29/38
See application file for complete search history.

(56) References Cited

U.S. PATENT DOCUMENTS 6,494,553 B1 * 12/2002 Donahue ..... B41J 2/1752 347/7
2002/0085050 A1 * 7/2002 Aruga ..... B41J 2/17509 347/7
2011/0229157 A1 9/2011 Kawai

FOREIGN PATENT DOCUMENTS

EP 2607080 A1 6/2013
JP H05-16384 A 1/1993
JP 2002-210998 A 7/2002
JP 2003-63028 A 3/2003
JP 2003-266726 A 9/2003
JP 2005-35103 A 2/2005
(Continued)

OTHER PUBLICATIONS

International Search Report dated Jan. 29, 2019 issued in PCT/JP2018/043948, 5 pages.
(Continued)

*Primary Examiner* — Jason S Uhlenhake
(74) *Attorney, Agent, or Firm* — Scully, Scott, Murphy & Presser, PC

(57) ABSTRACT

A controller determines, for each cartridge, whether a remaining amount in a first liquid chamber is smaller than a first liquid amount; in response to determining that a first cartridge exists for which the remaining amount is smaller than the first liquid amount, determines, for each cartridge other than the first cartridge, whether the remaining amount is smaller than a second liquid amount larger than the first liquid amount; in response to determining that a second cartridge exists, determines whether a remaining amount of the second cartridge is smaller than the first liquid amount, the second cartridge having the remaining amount smaller than the second liquid amount; and in response to determining that a particular second cartridge exists, displays a first screen including a first object that prompts replacement of the first cartridge and the particular second cartridge having the remaining amount smaller than the first liquid amount.

11 Claims, 15 Drawing Sheets

(56) References Cited

FOREIGN PATENT DOCUMENTS

| | | | |
|---|---|---|---|
| JP | 2006-56013 | A | 3/2006 |
| JP | 2008-74011 | A | 4/2008 |
| JP | 2010-69619 | A | 4/2010 |
| JP | 2010-247485 | A | 11/2010 |
| JP | 2011-88374 | A | 5/2011 |
| JP | 2011-191433 | A | 9/2011 |
| JP | 2011-197293 | A | 10/2011 |
| JP | 2016-83914 | A | 5/2016 |
| JP | 2017-226097 | A | 12/2017 |

OTHER PUBLICATIONS

International Preliminary Report on Patentability and Written Opinion dated Oct. 6, 2020 issued in PCT/JP2018/043948.
Official Action dated Nov. 16, 2021 received from the Japanese Patent Office in related application JP 2018-066710 together with English language translation.

* cited by examiner

LIQUID CONSUMPTION APPARATUS

CROSS REFERENCE TO RELATED APPLICATIONS

This is a Continuation Application of International Application No. PCT/JP2018/043948 filed Nov. 29, 2018, which claims priority from Japanese Patent Application No. 2018-066710 filed Mar. 30, 2018. The entire content of each of the prior applications is incorporated herein by reference.

TECHNICAL FIELD

This disclosure relates to a liquid consumption apparatus on which a plurality of cartridges storing liquid is mounted.

BACKGROUND

A disclosed image forming apparatus switches toner near empty detection timing in accordance with the amount of toner replenished from a toner cartridge and print history data. When toner near empty is detected, a message to that effect is displayed to prompt the user to replace the toner cartridge.

There is a disclosed system in which an image forming apparatus inquires of a management apparatus whether to display that toner near empty is detected when toner near empty is detected. The image forming apparatus displays to that effect according to an instruction from the management apparatus when display is necessary, and does not display when there is no instruction.

SUMMARY

According to one aspect, this specification discloses a liquid consumption apparatus. The liquid consumption apparatus includes one or more mount case, a plurality of tanks, a plurality of liquid channels, a head, a display, and a controller. A plurality of cartridges is mounted on the one or more mount case. Each of the plurality of cartridges has a first liquid chamber. Each of the plurality of tanks has a second liquid chamber. Each of the plurality of liquid channels has one end in communication with the second liquid chamber of one of the plurality of the tanks and another end in communication with the first liquid chamber of a corresponding one of the plurality of cartridges mounted on the one or more mount case. The head has nozzles in communication with the second liquid chamber. The head is configured to eject liquid from the nozzles. The controller is configured to: determine, for each of the plurality of cartridges, whether a remaining amount of liquid in the first liquid chamber is smaller than a first liquid amount; in response to determining that a first cartridge exists in the plurality of cartridges, determine, for each cartridge other than the first cartridge among the plurality of cartridges, whether a remaining amount of liquid in the first liquid chamber is smaller than a second liquid amount, the first cartridge being a cartridge for which it is determined that the remaining amount is smaller than the first liquid amount, the second liquid amount being larger than the first liquid amount; in response to determining that a second cartridge exists in the plurality of cartridges, determine whether a remaining amount of liquid in the first liquid chamber of the second cartridge is smaller than the first liquid amount, the second cartridge being a cartridge for which it is determined that the remaining amount is smaller than the second liquid amount; and in response to determining that a particular second cartridge exists, control the display to display a first screen including a first object that prompts replacement of the first cartridge and the particular second cartridge, the particular second cartridge being the second cartridge for which it is determined that the remaining amount is smaller than the first liquid amount.

BRIEF DESCRIPTION OF THE DRAWINGS

Embodiments in accordance with this disclosure will be described in detail with reference to the following figures wherein:

FIGS. 1A and 1B are external perspective views of a printer 10, wherein FIG. 1A shows a state where a cover 87 is in the covering position, and FIG. 1B shows a state where the cover 87 is in the open position;

FIGS. 4A and 4B are diagrams showing the structure of a cartridge 200, wherein FIG. 4A is a front perspective view and FIG. 4B is a vertical cross-sectional view;

DETAILED DESCRIPTION

In the above technique, when toner near empty is detected for one toner cartridge, display on the display means or inquiry to the management apparatus is performed. At this time, the state of other toner cartridges is not considered. Accordingly, immediately after the user replaces one toner cartridge based on the display of the toner near empty, if the toner near empty of another toner cartridge is detected, a display prompting the user to replace the toner cartridge is displayed again. Then, the user has to replace the toner cartridge again, which is duplication of effort.

In view of the foregoing, an aspect of an object of the present disclosure is to provide means capable of reducing the trouble of cartridge replacement.

Hereinafter, embodiments of the present disclosure will be described. The embodiments described below are merely examples of the present disclosure, and it is needless to say that the embodiments of the present disclosure can be changed as appropriate without departing from the scope of the claims. Moreover, the execution order of each processing described later can be changed suitably in the range without departing from the scope of the claims.

Overview of Printer 10

Figure 1A:
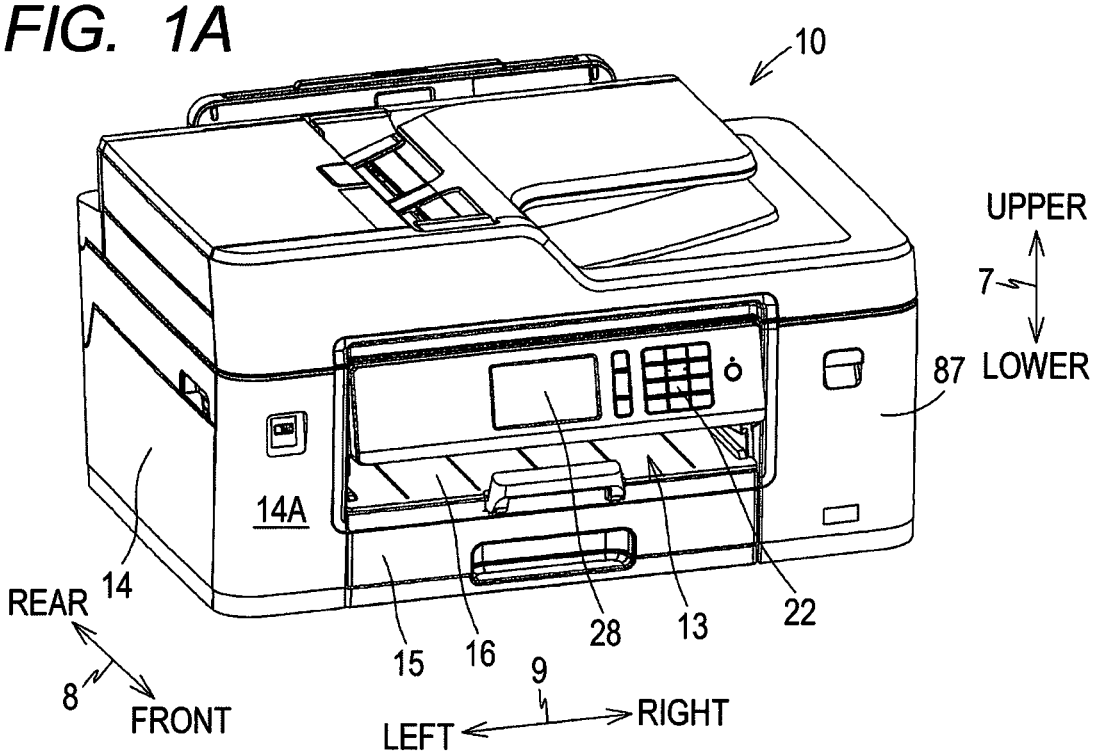

In the present embodiment, a printer 10 shown in FIGS. 1A and 1B will be described. The printer 10 is an inkjet printer that ejects ink droplets and prints an image on a sheet. The printer 10 may be a multifunction peripheral having functions such as a facsimile function, a scan function, and a copy function. The printer 10 is an example of a liquid consumption apparatus.

In the following, an upper-lower direction 7 is defined with reference to a usage posture installed on a horizontal plane so that the printer 10 can be used. A front-rear direction 8 is defined assuming that the surface on which an opening 13 of the printer 10 is formed is the front surface. A left-right direction 9 is defined in a state where the printer 10 is viewed from the front. That is, in the usage posture, the upper-lower direction 7 corresponds to the vertical direction, and the front-rear direction 8 and the left-right direction 9 correspond to the horizontal direction. The front-rear direction 8 and the left-right direction 9 are perpendicular to each other.

Figure 2:
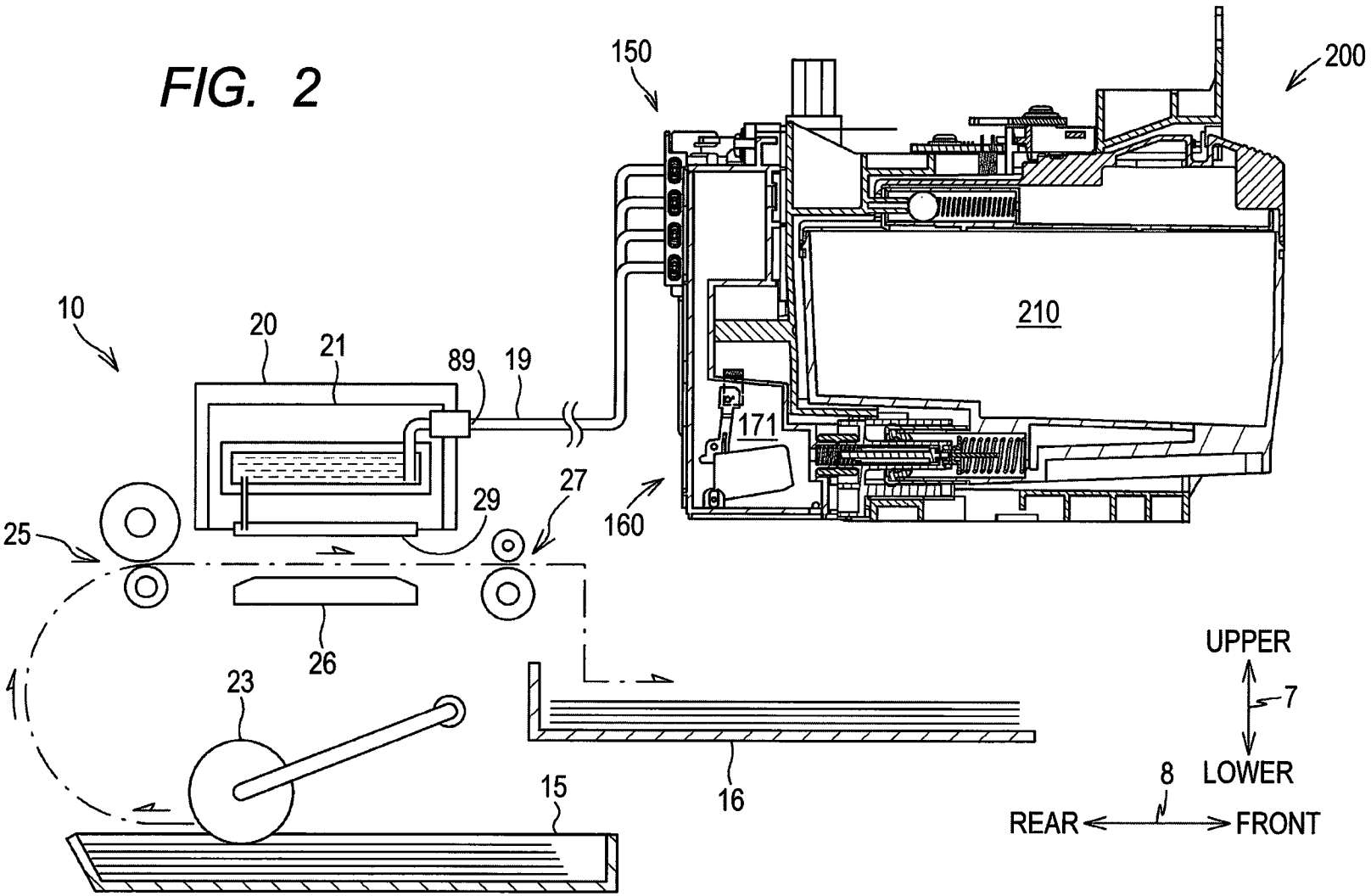
FIG. 2 is a schematic cross-sectional view schematically showing the internal structure of the printer 10.
Figure 3:
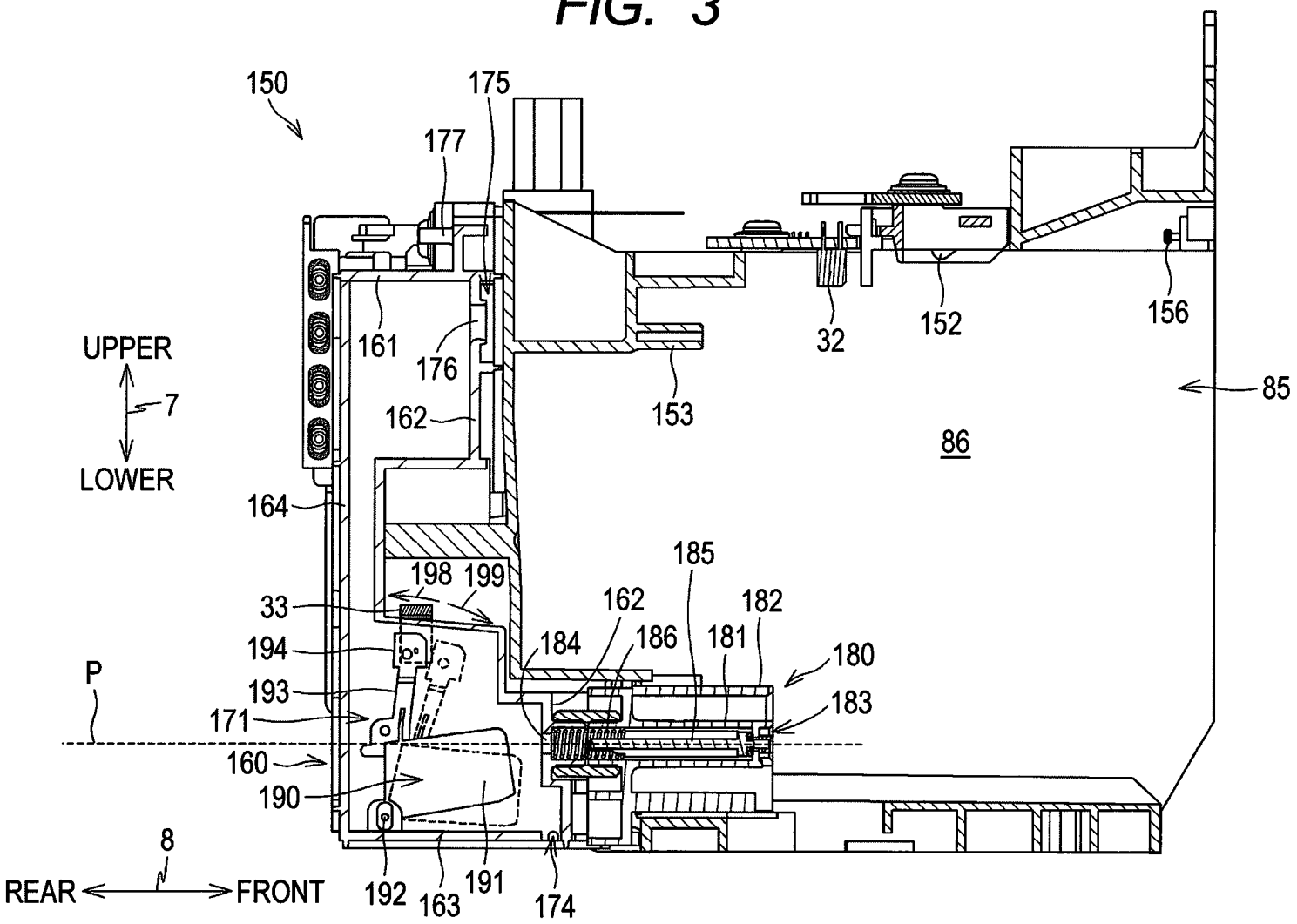
FIG. 3 is a vertical cross-sectional view of a mount case 150.

The printer 10 has a substantially rectangular parallelepiped housing 14. As shown in FIGS. 2 and 3, a feed tray 15, a feed roller 23, a conveyance roller 25, a head 21 having a plurality of nozzles 29, a platen 26, a discharge roller 27, a discharge tray 16, a mount case 150, and tanks 160 are located within the housing 14.

The printer 10 drives the feed roller 23 and the conveyance roller 25 to convey the sheet supported on the feed tray 15 to the position of the platen 26. Next, the printer 10 causes the head 21 to eject the ink supplied from the tank 160 through a tube 19 through the nozzle 29. With this operation, ink lands on the sheet supported by the platen 26, and an image is printed on the sheet. Then, the printer 10 drives the discharge roller 27 to discharge the sheet on which the image is printed to the discharge tray 16.

More specifically, the head 21 is mounted on a carriage 20 that reciprocates along a main scanning direction (parallel to the left-right direction 9) that intersects the sheet conveyance direction by the conveyance roller 25. The carriage 20 receives a driving force of a motor (not shown) and moves along the main scanning direction (direction perpendicular to the paper surface of FIG. 2). While the conveyance of the sheet by the conveyance roller 25 is stopped, the printer 10 causes the head 21 to eject ink through the nozzles 29 while moving the carriage 20 along the main scanning direction. With this operation, an image is printed in a part of the region of the sheet facing the head 21 (hereinafter referred to as "one pass"). Next, the printer 10 causes the conveyance roller 25 to convey the sheet so that the region where the image is to be printed next faces the head 21. By repeatedly executing these processing alternately, an image is printed on one sheet.

Display 28

The housing 14 has a display 28. The display 28 is located on the front surface of the housing 14. The display 28 is a so-called touch panel in which a touch sensor is disposed on a display panel. However, instead of the display 28 or together with the display 28, a display panel and push buttons may be located on the front surface of the housing 14. The display 28 receives an input from the user.

Cover 87

Figure 1B:
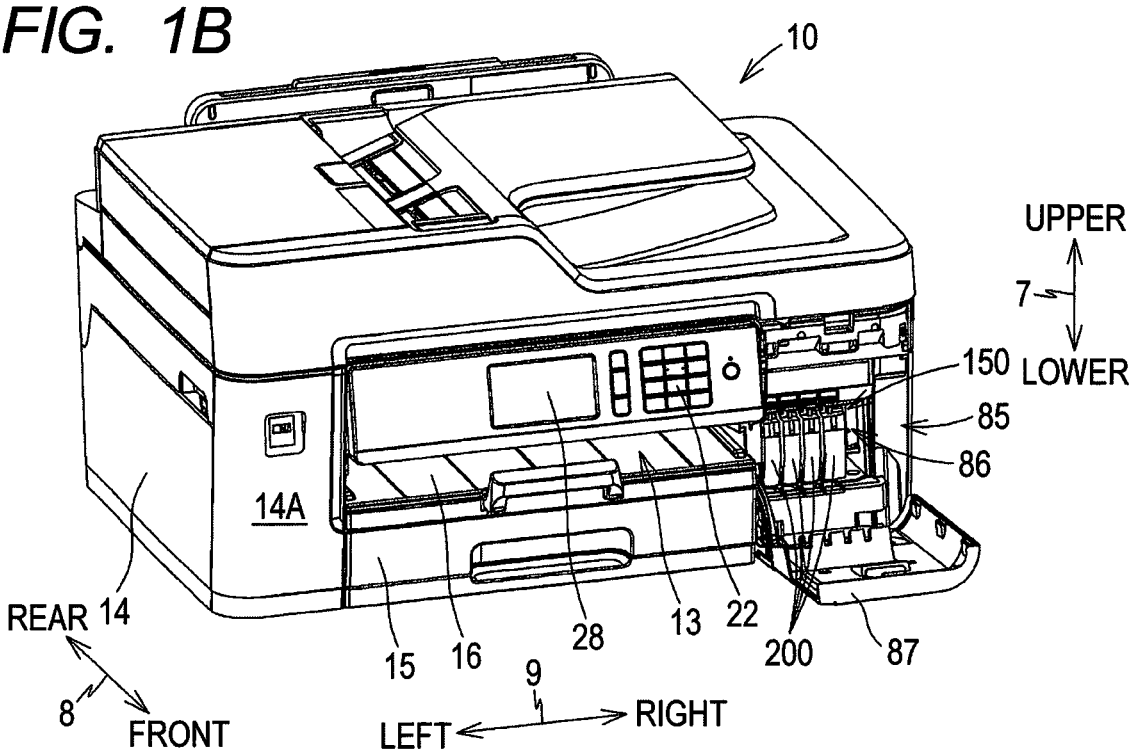

As shown in FIG. 1B, an opening 85 is formed on the front surface 14A of the housing 14 and on the right end of the housing 14 in the left-right direction 9. The housing 14 further includes a cover 87. The cover 87 is rotatable between a covering position (the position shown in FIG. 1A) covering the opening 85 and an open position (the position shown in FIG. 1B) opening the opening 85. For example, the cover 87 is supported by the housing 14 so as to be rotatable about a rotation axis extending in the left-right direction 9 in the vicinity of the lower end of the housing 14. The mount case 150 on which cartridges 200 are mounted is located in a housing space 86 inside the housing 14 that extends at the back of the opening 85.

Mount Case 150

As shown in FIG. 3, the mount case 150 includes a contact 152, a rod 153, a cartridge mount sensor (referred to as "mount sensor") 32, a liquid level sensor 33, and a lock pin 156. The mount case 150 is configured to accommodate four cartridges 200 corresponding to each color of black, cyan, magenta, and yellow. That is, the mount case 150 includes four contacts 152, four rods 153, four mount sensors 32, and four liquid level sensors 33 corresponding to the four cartridges 200. The number of cartridges 200 that can be accommodated in the mount case 150 is not limited to four. Further, a plurality of mount cases may be provided such that each of the plurality of mount cases accommodates one cartridge.

The mount case 150 has a box shape having an internal space for accommodating the mounted cartridges 200. The inner space of the mount case 150 is defined by a top wall that defines an upper end, a bottom wall that defines a lower end, a rear wall that defines a rear end in the front-rear direction 8, and a pair of side walls that define both ends in the left-right direction 9. On the other hand, the position facing the rear wall of the mount case 150 is the opening 85. That is, the opening 85 opens the internal space of the mount case 150 to the outside of the printer 10 when the cover 87 is located at the open position.

The cartridge 200 is mounted on the mount case 150 and is removed from the mount case 150 through the opening 85 of the housing 14. More specifically, the cartridge 200 passes through the opening 85 rearward in the front-rear direction 8 and is mounted on the mount case 150. The cartridge 200 removed from the mount case 150 passes through the opening 85 forward in the front-rear direction 8.

Contact 152

The contact 152 is located on the top wall of the mount case 150. The contact 152 protrudes downward from the top wall toward the internal space of the mount case 150. The contact 152 is located at a position in contact with an electrode 248 (described later) of the cartridge 200 when the cartridge 200 is mounted on the mount case 150. The contact 152 has conductivity, and can be elastically deformed in the upper-lower direction 7. The contact 152 is electrically connected to a controller 130.

Rod 153

The rod 153 protrudes forward from the rear wall of the mount case 150. The rod 153 is located above a joint 180 described later on the rear wall of the mount case 150. The rod 153 enters an atmospheric valve chamber 214 described later through an atmosphere communication port 221 described later of the cartridge 200 in the processing of mounting the cartridge 200 on the mount case 150. When the rod 153 enters the atmospheric valve chamber 214, the atmospheric valve chamber 214 is communicated with the atmosphere.

Mount Sensor 32

The mount sensor 32 is located on the top wall of the mount case 150. The mount sensor 32 is a sensor for detecting whether the cartridge 200 is mounted on the mount case 150. The mount sensor 32 includes a light emitting portion and a light receiving portion that are spaced apart in the left-right direction 9. In a state where the cartridge 200 is mounted on the mount case 150, a light shielding rib 245 described later of the cartridge 200 is positioned between the light emitting portion and the light receiving portion of the mount sensor 32. In other words, the light emitting portion and the light receiving portion of the mount sensor 32 are positioned in a state of facing each other with the light shielding rib 245 of the cartridge 200 mounted on the mount case 150 interposed therebetween.

The mount sensor 32 outputs different signals (hereinafter referred to as "mount signal") depending on whether the light emitted from the light emitting portion along the left-right direction 9 is received by the light receiving portion. For example, the mount sensor 32 outputs a low level signal to the controller 130 in response to the received light intensity of the light received by the light receiving portion being lower than the threshold intensity. The mount sensor 32 outputs a high level signal having a signal intensity higher than the low level signal to the controller 130 in response to the received light intensity of the light received by the light receiving portion being higher than or equal to the threshold intensity.

Liquid Level Sensor 33

The liquid level sensor 33 is a sensor for detecting whether a detected part 194 of an actuator 190 described later is located at a detection position. The liquid level sensor 33 includes a light emitting portion and a light receiving portion that are spaced apart in the left-right direction 9. In other words, when the detected part 194 is located at the detection position, the detected part 194 is located between the light emitting portion and the light receiving portion of the liquid level sensor 33. When the detected part 194 is not located at the detection position, the detected part 194 is not located between the light emitting portion and the light receiving portion of the liquid level sensor 33. The liquid level sensor 33 outputs different signals depending on whether the light outputted from the light emitting portion is received by the light receiving portion. For example, the liquid level sensor 33 outputs a low level signal to the controller 130 in response to the received light intensity of the light received by the light receiving portion being lower than a threshold intensity. On the other hand, the liquid level sensor 33 outputs a high level signal having a signal intensity higher than the low level signal to the controller 130 in response to the received light intensity of the light received by the light receiving portion being higher than or equal to the threshold intensity.

Lock Pin 156

The lock pin 156 is a bar-like member extending along the left-right direction 9 at the upper end of the internal space of the mount case 150 and in the vicinity of the opening 85. Both ends of the lock pin 156 in the left-right direction 9 are fixed to the pair of side walls of the mount case 150. The lock pin 156 extends in the left-right direction 9 over four spaces in which the four cartridges 200 are accommodated. The lock pin 156 is for holding the cartridges 200 mounted on the mount case 150 in a mount position shown in FIG. 5. The cartridges 200 are fixed to the lock pin 156 in a state where the cartridges 200 are mounted on the mount case 150.

Tank 160

The printer 10 includes four tanks 160 for respective ones of the four cartridges 200. Specifically, the printer 10 includes the tank 160 storing magenta ink corresponding to the cartridge 200 storing magenta ink, the tank 160 storing cyan ink corresponding to the cartridge 200 storing cyan ink, the tank 160 storing yellow ink corresponding to the cartridge 200 storing yellow ink, and the tank 160 storing black ink corresponding to the cartridge 200 storing black ink. Since the configuration of the four tanks 160 is generally common, one tank 160 will be described below.

The tank 160 is located further rearward than the rear wall of the mount case 150. As shown in FIG. 3, the tank 160 includes an upper wall 161, a front wall 162, a lower wall 163, a rear wall 164, and a pair of side walls (not shown). The front wall 162 is composed of a plurality of walls each shifted in the front-rear direction 8. A liquid chamber 171 is formed inside the tank 160. The liquid chamber 171 is an example of a second liquid chamber.

Of the walls constituting the tank 160, at least the wall facing the liquid level sensor 33 has translucency. Thus, the light outputted from the liquid level sensor 33 passes through the wall facing the liquid level sensor 33. At least part of the rear wall 164 may be a film welded to the upper wall 161, the lower wall 163, and the end surfaces of the side walls. The side walls of the tank 160 may be common to the mount case 150 or may be independent of the mount case 150. The tanks 160 adjacent in the left-right direction 9 are partitioned by a partition wall (not shown).

The liquid chamber 171 communicates with an ink channel (not shown) through an outflow port 174. The lower end of the outflow port 174 is defined by a lower wall 163 that defines the lower end of the liquid chamber 171. The outflow port 174 is located at a lower position than the joint 180 (more specifically, the lower end of a through hole 184). An ink flow path (not shown) connected to the outflow port 174 is connected to the tube 19. Thus, the liquid chamber 171 communicates with the head 21 from the outflow port 174 through the ink flow path and the tube 19. That is, the ink stored in the liquid chamber 171 is supplied to the head 21 from the outflow port 174 through the ink flow path and the tube 19. The ink flow path communicated with the outflow port 174 and tube 19 have one end (the outflow port 174) communicated with the liquid chamber 171 and an other end 89 (see FIG. 2) communicated with the head 21.

The liquid chamber 171 communicates with the atmosphere through the atmosphere communication chamber 175. More specifically, the atmosphere communication chamber 175 communicates with the liquid chamber 171 through a through hole 176 that penetrates the front wall 162. The atmosphere communication chamber 175 communicates with the outside of the printer 10 through an atmosphere communication port 177 and a tube (not shown) connected to the atmosphere communication port 177. In other words, the atmosphere communication chamber 175 has one end (the through hole 176) communicated with the liquid chamber 171 and the other end (the atmosphere communication port 177) communicated with the outside of the printer 10. The atmosphere communication chamber 175 communicates with the atmosphere through the atmosphere communication port 177 and the tube (not shown).

Joint 180

As shown in FIG. 3, the joint 180 includes a needle 181 and a guide 182. The needle 181 is a tube having a flow path formed therein. The needle 181 protrudes forward from the front wall 162 that defines the liquid chamber 171. An opening 183 is formed at the front end of the needle 181. The internal space of the needle 181 is communicated with the liquid chamber 171 through a through hole 184 that penetrates the front wall 162. One end (the opening 183) of the needle 181 communicates with the outside of the tank 160, and the other end (the through hole 184) communicates with the liquid chamber 171. The guide 182 is a cylindrical member disposed around the needle 181. The guide 182 protrudes forward from the front wall 162 and has an open front end.

A valve 185 and a coil spring 186 are located in the internal space of the needle 181. The valve 185 is configured to move along the front-rear direction 8 between the close position and the open position in the internal space of the needle 181. The valve 185 closes the opening 183 when located at the close position. The valve 185 opens the opening 183 when located at the open position. The coil spring 186 urges the valve 185 in a direction to move the valve 185 from the open position to the close position, that is, forward in the front-rear direction 8. The internal space of the needle 181 is an example of a flow path (channel).

Actuator 190

As shown in FIG. 3, the actuator 190 is located in the liquid chamber 171. The actuator 190 is supported by a support member (not shown) disposed in the liquid chamber 171 so as to be rotatably moved in the directions of arrows 198 and 199. The actuator 190 is rotatably moved between a first state indicated by a solid line in FIG. 3 and a second state indicated by a dashed line. The actuator 190 is restricted from rotatably moving in the direction of the arrow 198 from the position of the solid line by a stopper (not shown) (for example, the inner wall of the liquid chamber 171). The actuator 190 includes a float 191, a shaft 192, an arm 193, and a detected part 194. The actuator 190 is an example of a detection object.

The float 191 is formed of a material having a specific gravity smaller than that of the ink stored in the liquid chamber 171. The shaft 192 protrudes in the left-right direction 9 from the right and left surfaces of the float 191. The shaft 192 is inserted into a hole (not shown) formed in a support member. With this configuration, the actuator 190 is supported by the support member so as to be rotatably moved about the shaft 192. The arm 193 extends substantially upward from the float 191. The detected part 194 is located at the tip of the arm 193. That is, the arm 193 is located between the detected part 194 and the shaft 192. The detected part 194 is a plate-like member extending along the upper-lower direction 7 and the front-rear direction 8. The detected part 194 is formed of a material or color that blocks light outputted from the light emitting portion of the liquid level sensor 33.

When the ink level stored in the liquid chamber 171 is higher than or equal to a reference position P, the actuator 190 rotated in the direction of the arrow 198 by buoyancy is held at the detection position indicated by the solid line in FIG. 3. On the other hand, when the ink level is lower than the reference position P, the actuator 190 rotates in the direction of the arrow 199 following the drop of the liquid level. Thus, the detected part 194 of the actuator 190 moves to a position different from the detection position. Since the detected part 194 is a part of the actuator 190, the detected part 194 moves to a position corresponding to the amount of ink stored in the liquid chamber 171.

The reference position P is the same height as the axis center of the needle 181 in the upper-lower direction 7 and the same height as the center of an ink supply port 234 described later. However, the reference position P is not limited to the above position as long as it is above the outflow port 174 in the upper-lower direction 7. As another example, the reference position P may be the height of the upper end or the lower end of the internal space of the needle 181, or the height of the upper end or the lower end of the ink supply port 234.

When the liquid level of the ink stored in the liquid chamber 171 is higher than or equal to the reference position P, the light outputted from the light emitting portion of the liquid level sensor 33 is blocked by the detected part 194 located at the detection position. Accordingly, the liquid level sensor 33 outputs a low level signal to the controller 130 because the light from the light emitting portion does not reach the light receiving portion. On the other hand, when the liquid level of the ink stored in the liquid chamber 171 is lower than the reference position P, the liquid level sensor 33 outputs a high level signal to the controller 130 because the light outputted from the light emitting portion reaches the light receiving portion. That is, the controller 130 detects whether the liquid level of the ink stored in the liquid chamber 171 is higher than or equal to the reference position P, based on the signal outputted from the liquid level sensor 33. The reference position P is an example of a particular position. The low level signal "L" is an example of a first signal, and the high level signal "H" is an example of a second signal. Hereinafter, the low level signal may be described as "L" and the high level signal as "H".

Cartridge 200

The cartridge 200 is a container having a liquid chamber 210 (see FIG. 2) for storing ink, which is liquid. The liquid chamber 210 is an example of a first liquid chamber.

Figure 4A:
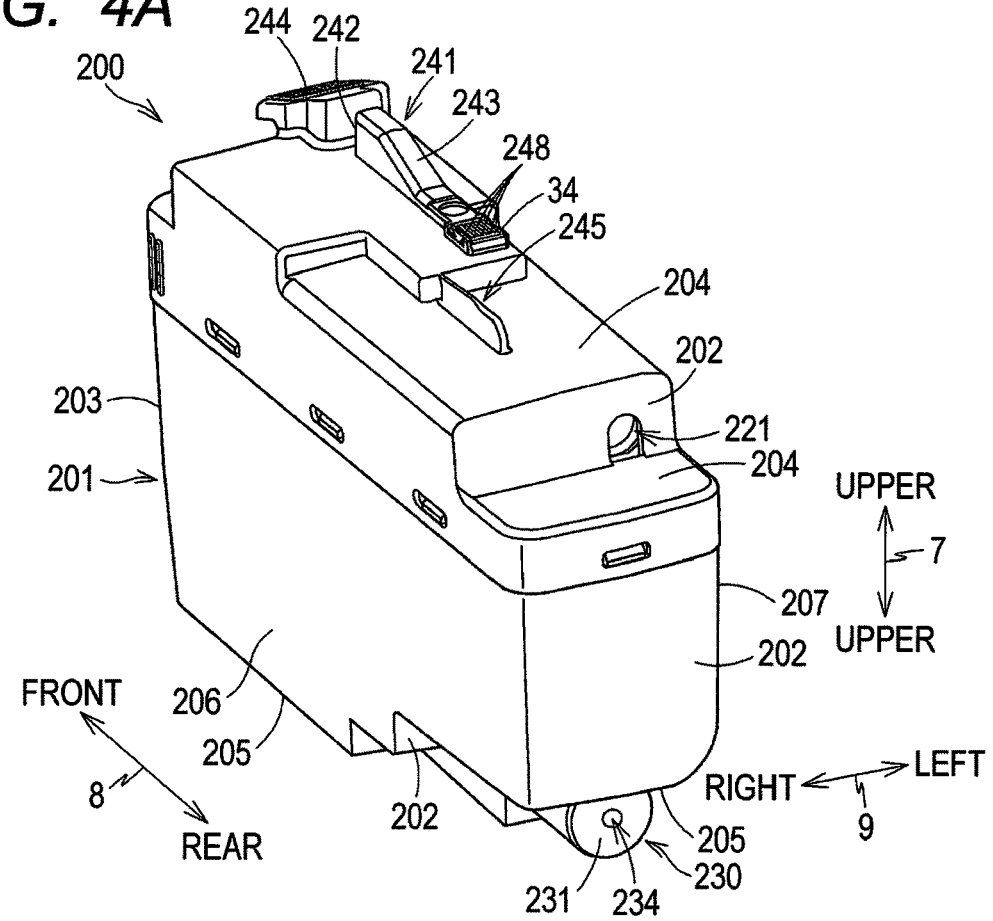

The liquid chamber 210 is defined by, for example, a resin wall. As shown in FIG. 4A, the cartridge 200 has a flat shape in which the sizes along the upper-lower direction 7 and the front-rear direction 8 are larger than the size along the left-right direction 9. Note that the outer shapes of the cartridges 200 in which ink of different colors is stored may be the same or different. At least part of the walls constituting the cartridge 200 has translucency. With this configuration, the user can visually recognize the liquid level of the ink stored in the liquid chamber 210 of the cartridge 200 from the outside of the cartridge 200.

The cartridge 200 includes a housing 201 and a supply pipe 230. The housing 201 includes a rear wall 202, a front wall 203, an upper wall 204, a lower wall 205, and a pair of side walls 206 and 207. The rear wall 202 is composed of a plurality of walls each shifted in the front-rear direction 8. The upper wall 204 is constituted by a plurality of walls each shifted in the upper-lower direction 7. The lower wall 205 is constituted by a plurality of walls each shifted in the upper-lower direction 7.

Figure 4B:
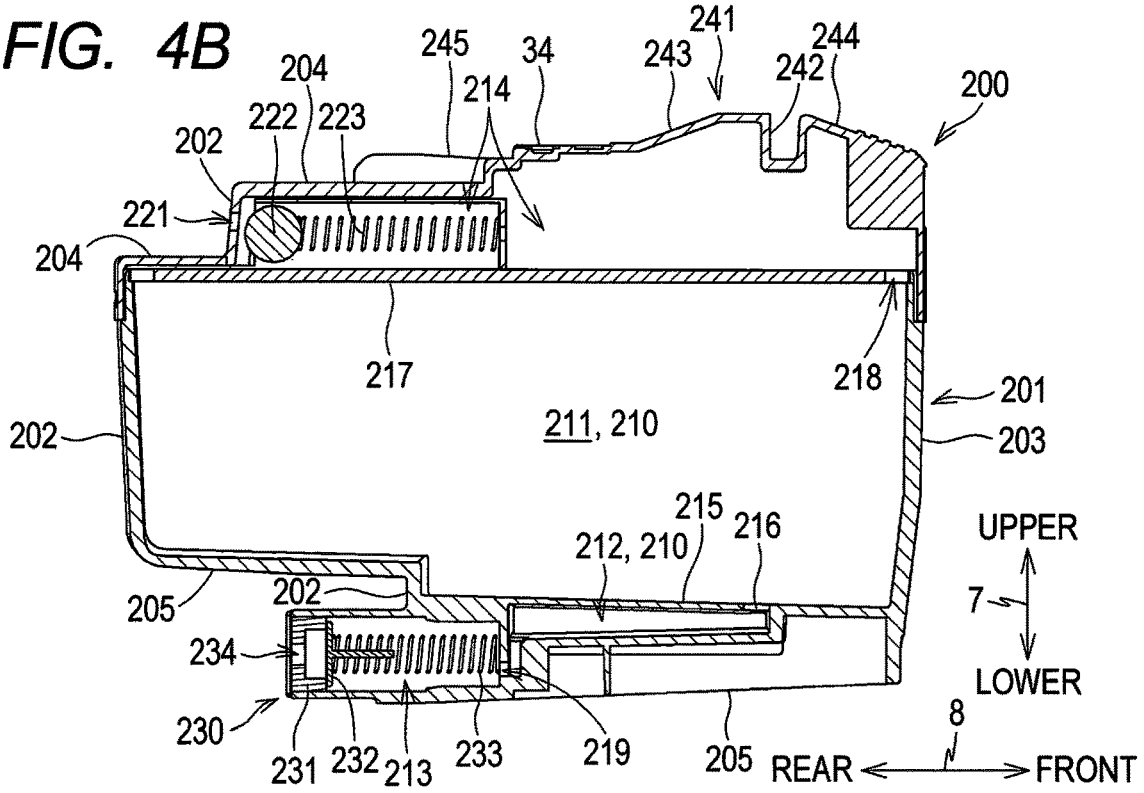

In the internal space of the cartridge 200, as shown in FIG. 4B, a liquid chamber 210, an ink valve chamber 213, and an atmospheric valve chamber 214 are formed. The liquid chamber 210 has an upper liquid chamber 211 and a lower liquid chamber 212. The upper liquid chamber 211, the lower liquid chamber 212, and the atmospheric valve chamber 214 are internal spaces of the housing 201. On the other hand, the ink valve chamber 213 is an internal space of the supply pipe 230. The liquid chamber 210 stores ink. The atmospheric valve chamber 214 causes the liquid chamber 210 to communicate with the outside of the cartridge 200.

The upper liquid chamber 211 and the lower liquid chamber 212 of the liquid chamber 210 are separated in the upper-lower direction 7 by a partition wall 215 that partitions the internal space of the housing 201. The upper liquid chamber 211 and the lower liquid chamber 212 are communicated with each other through a through hole 216 formed in the partition wall 215. The upper liquid chamber 211 and the atmospheric valve chamber 214 are separated by a partition wall 217 that partitions the internal space of the housing 201. The upper liquid chamber 211 and the atmospheric valve chamber 214 are communicated with each other through a through hole 218 formed in the partition wall 217. The ink valve chamber 213 communicates with the lower end of the lower liquid chamber 212 through a through hole 219.

The atmospheric valve chamber 214 communicates with the outside of the cartridge 200 through the atmosphere communication port 221 formed in the rear wall 202 at the upper part of the cartridge 200. That is, the atmospheric valve chamber 214 has one end (the through hole 218) communicated with the liquid chamber 210 (more specifically, the upper liquid chamber 211), and the other end (the atmosphere communication port 221) communicated with the outside of the cartridge 200. Note that the atmospheric valve chamber 214 communicates with the atmosphere through the atmosphere communication port 221. A valve 222 and a coil spring 223 are located in the atmospheric valve chamber 214. The valve 222 is movable along the front-rear direction 8 between a close position and an open position. When the valve 222 is located at the close position, the atmosphere communication port 221 is closed. When the valve 222 is located at the open position, the air communication port 221 is opened. The coil spring 223 urges the valve 222 in a direction to move the valve 222 from the open position to the close position, that is, in the rearward direction along the front-rear direction 8.

In the processing of mounting the cartridge 200 on the mount case 150, the rod 153 enters the atmospheric valve chamber 214 through the atmosphere communication port 221. The rod 153 that has entered the atmospheric valve chamber 214 moves the valve 222 in the close position forward along the front-rear direction 8 against the urging force of the coil spring 223. Then, when the valve 222 is moved to the open position, the upper liquid chamber 211 is communicated with the atmosphere. Note that the configuration for opening the atmosphere communication port 221 is not limited to the above example. As another example, the rod 153 may break through a film that seals the atmosphere communication port 221.

The supply pipe 230 protrudes rearward along the front-rear direction 8 from the rear wall 202 at the lower part of the housing 201. The supply pipe 230 has an open rear end. That is, the ink valve chamber 213 causes the liquid chamber 210 communicated through the through hole 219 to communicate with the outside of the cartridge 200. The ink valve chamber 213 has one end (the through hole 219) communicated with the liquid chamber 210 (more specifically, the lower liquid chamber 212) and the other end (the ink supply port 234 described later) communicated with the outside of the cartridge 200. Further, a packing 231, a valve 232, and a coil spring 233 are located in the ink valve chamber 213.

In the center of the packing 231, the ink supply port 234 that penetrates in the front-rear direction 8 is formed. The inner diameter of the ink supply port 234 is slightly smaller than the outer diameter of the needle 181. The valve 232 is movable along the front-rear direction 8 between a close position and an open position. When the valve 232 is located at the close position, the ink supply port 234 is closed by contacting the packing 231. When the valve 232 is located at the open position, the valve 232 separates from the packing 231 and opens the ink supply port 234. The coil spring 233 urges the valve 232 in a direction to move the valve 232 from the open position to the close position, that is, in the rearward direction along the front-rear direction 8. The urging force of the coil spring 233 is larger than the urging force of the coil spring 186.

In the processing of mounting the cartridge 200 in the mount case 150, the supply pipe 230 enters the guide 182, and then the needle 181 enters the ink valve chamber 213 through the ink supply port 234. At this time, the needle 181 is in fluid-tight contact with the inner peripheral surface defining the ink supply port 234 while elastically deforming the packing 231. When the cartridge 200 is further inserted into the mount case 150, the needle 181 moves the valve 232 forward against the urging force of the coil spring 233. Further, the valve 232 moves the valve 185 protruding from the opening 183 of the needle 181 rearward against the urging force of the coil spring 186.

Figure 5:
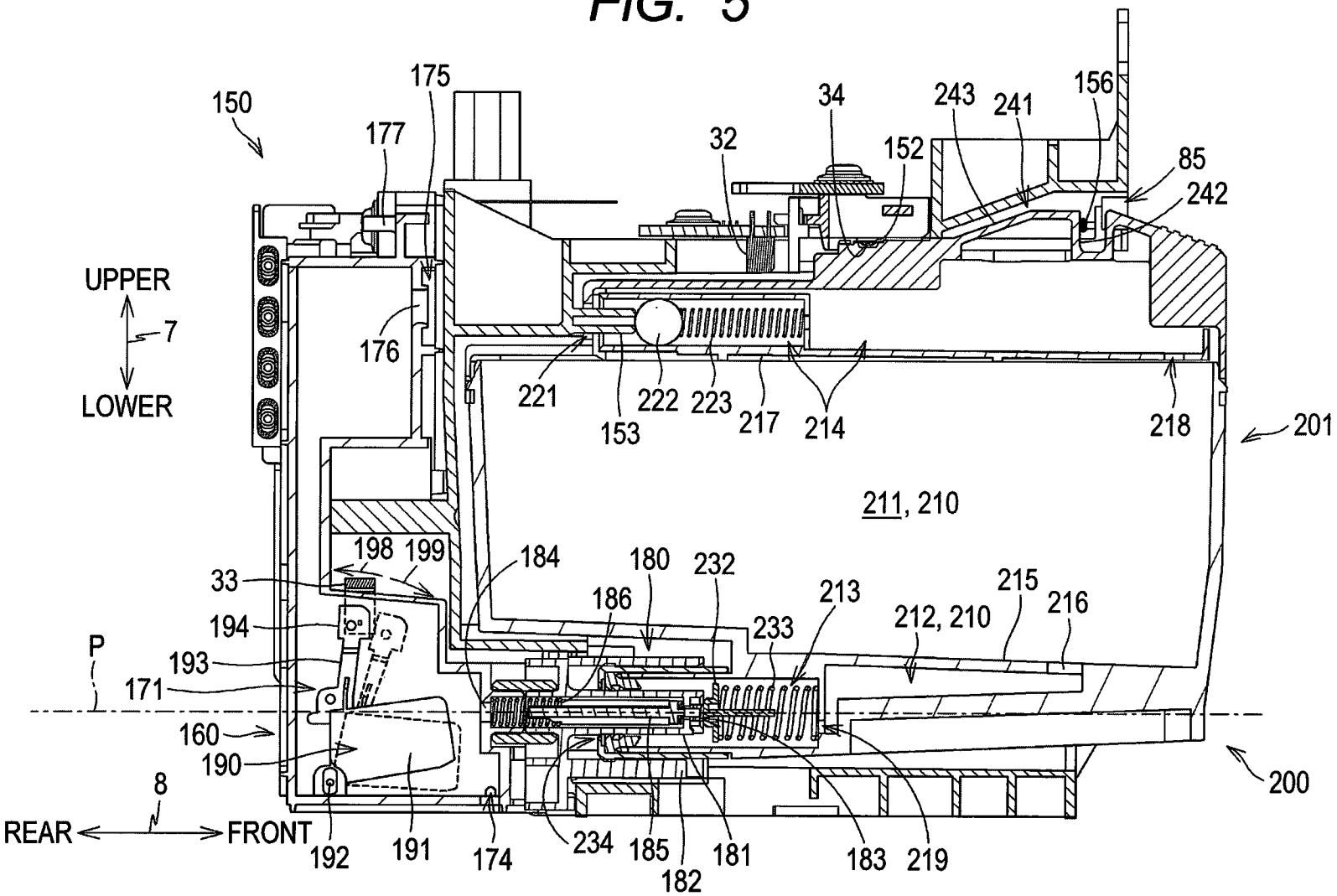
FIG. 5 is a vertical cross-sectional view of the mount case 150 with the cartridge 200 mounted.

With this operation, as shown in FIG. 5, the ink supply port 234 and the opening 183 are opened, and the ink valve chamber 213 of the supply pipe 230 communicates with the internal space of the needle 181.

In a state where the cartridge 200 is mounted in the mount case 150, a part of the liquid chamber 210 and a part of the liquid chamber 171 overlap each other when viewed in a horizontal direction. The bottom of the liquid chamber 171 is located at a lower position than the bottom of the liquid chamber 210. With this configuration, the ink stored in the liquid chamber 210 flows out to the liquid chamber 171 of the tank 160 through the connected supply pipe 230 and the joint 180 due to the difference between the head of the liquid chamber 210 and the head of the liquid chamber 171.

As shown in FIGS. 4A and 4B, a protrusion 241 is formed on the upper wall 204. The protrusion 241 protrudes upward from the outer surface of the upper wall 204 and extends along the front-rear direction 8. The protrusion 241 has a lock surface 242 and an inclined surface 243. The lock surface 242 and the inclined surface 243 are located at higher positions than the upper wall 204. The lock surface 242 faces forward along the front-rear direction 8 and extends along each of the upper-lower direction 7 and the left-right direction 9 (that is, substantially perpendicular to the upper wall 204). The inclined surface 243 is inclined with respect to the upper wall 204 so as to face upward and rearward.

The lock surface 242 is a surface that comes into contact with the lock pin 156 when the cartridge 200 is mounted on the mount case 150. The inclined surface 243 is a surface that guides the lock pin 156 to a position in contact with the lock surface 242 in the processing of mounting the cartridge 200 on the mount case 150. When the lock surface 242 and the lock pin 156 are in contact with each other, the cartridge 200 is held at the mount position shown in FIG. 5 against the urging force of the coil springs 186, 223, and 233.

A flat plate-like member is formed so as to extend upward from the upper wall 204 in front of the lock surface 242. The upper surface of the flat plate member is an operation portion 244 that is operated by the user when the cartridge 200 is removed from the mount case 150. When the cartridge 200 is mounted on the mount case 150 and the cover 87 is in the open position, the operation portion 244 can be operated by the user. When the operation portion 244 is pressed downward, the cartridge 200 rotates to move the lock surface 242 downward to a position lower than the lock pin 156. Consequently, the cartridge 200 can be removed from the mount case 150.

As shown in FIGS. 4A and 4B, the light shielding rib 245 is formed on the outer surface of the upper wall 204 and rearward of the protrusions 241. The light shielding rib 245 protrudes upward from the outer surface of the upper wall 204 and extends along the front-rear direction 8. The light shielding rib 245 is formed of a material or a color that shields light outputted from the light emitting portion of the mount sensor 32. The light shielding rib 245 is located on the optical path from the light emitting portion to the light receiving portion of the mount sensor 32 in a state where the cartridge 200 is mounted on the mount case 150. That is, the mount sensor 32 outputs a low level signal to the controller 130 (FIG. 6A) in response to the mounting of the cartridge 200 on the mount case 150. On the other hand, the mount sensor 32 outputs a high level signal to the controller 130 in response to the cartridge 200 being not mounted on the mount case 150. That is, the controller 130 detects whether the cartridge 200 is mounted on the mount case 150 based on the signal outputted from the mount sensor 32.

As shown in FIGS. 4A and 4B, the IC chip 34 is located on the outer surface of the upper wall 204 and between the light shielding rib 245 and the protrusion 241 in the front-rear direction 8. An electrode 248 is formed on the IC chip 34. The IC chip 34 includes a memory (not shown). The electrode 248 is electrically connected to the memory of the IC chip 34. The electrode 248 is exposed on the upper surface of the IC chip 34 so as to be conductive with the contact 152. That is, the electrode 248 is electrically connected to the contact 152 in a state where the cartridge 200 is mounted on the mount case 150. The controller 130 reads information from the memory of the IC chip 34 through the contact 152 and the electrode 248, and writes information into the memory of the IC chip 34 through the contact 152 and the electrode 248.

The memory of the IC chip 34 stores type information, a serial number, and a cartridge remaining value of the cartridge 200. The type information is information indicating whether the cartridge 200 is a small-capacity cartridge or a large-capacity cartridge, the color of ink to be stored, and so on. The serial number is information for identifying each cartridge 200 individually. The cartridge remaining value is a value indicating the amount of ink stored in the cartridge 200. In an unused cartridge 200, the initial remaining value indicating the initial remaining ink amount is stored in the memory as the cartridge remaining value.

Controller 130

Figure 6A:
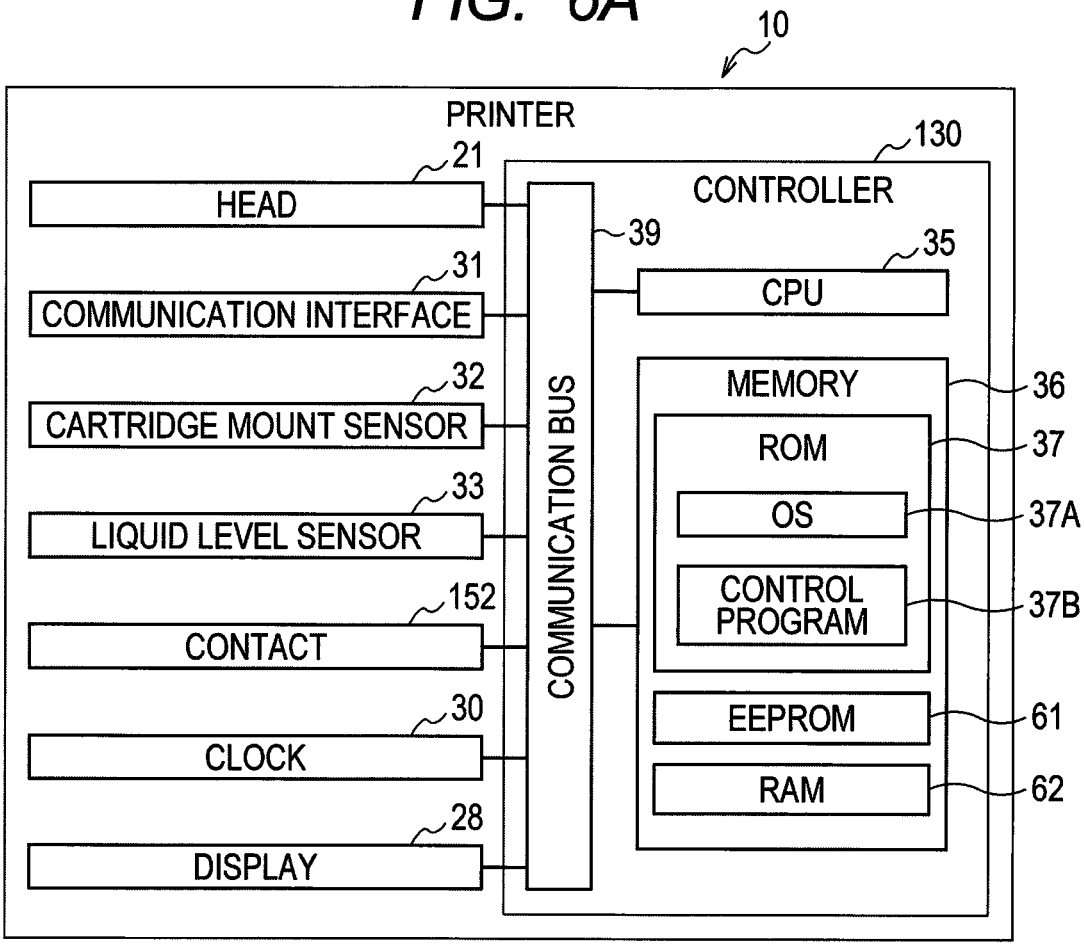
FIG. 6A is a block diagram of the printer 10.

The printer 10 includes a controller 130. As shown in FIG. 6A, the controller 130 includes a CPU 35, a storage portion 36, and a communication bus 39. The storage portion 36 includes a ROM 37, an EEPROM 61, and a RAM 62.

The ROM 37 stores an OS (abbreviation of Operating System) program 37A, a control program 37B, and so on. The control program 37B is a program that performs a print processing described later. The OS program 37A is a program that is different from the control program 37B, and further controls an operation different from the operation controlled by the control program 37B. The OS program 37A and the control program 37B are executed by the CPU 35 by processing the instructions described in the address. Hereinafter, an operation processed by executing the OS program 37A and the control program 37B may be described as an operation of the controller 130. The controller 130 may have a hardware circuit using an IC that realizes part or all of the operations executed by the OS program 37A and the control program 37B.

The EEPROM 61 stores device information of the printer 10. The device information includes identification information of the printer 10. The identification information of the printer 10 is the MAC address, serial number of the printer 10, and so on.

The EEPROM 61 stores a first ejection value, a second ejection value, an initial cartridge remaining value, an initial tank remaining value, an S_Empty flag, and a C_Empty flag. Details will be described later in the print processing.

The communication bus 39 is connected to the head 21, a communication interface (hereinafter referred to as communication I/F) 31, the mount sensor 32, the liquid level sensor 33, the contact 152, a clock 30, the display 28, a motor (not shown), and so on. The clock 30 outputs date and time information.

The controller 130 causes the feed roller 23, the conveyance roller 25, and the discharge roller 27 to rotate by driving the motor (not shown) through the communication bus 39. Further, the controller 130 causes the head 21 to eject ink droplets by outputting a drive signal to the drive elements of the head 21 through the communication bus 39.

Further, the controller 130 detects through the mount sensor 32 whether the cartridge 200 is mounted on the mount case 150. Further, the controller 130 detects through the liquid level sensor 33 whether the liquid level of the ink stored in the liquid chamber 171 is higher than or equal to the reference position P.

Further, the controller 130 reads out the type information, serial number, and cartridge remaining value stored in the memory of the IC chip 34 through the electrode 248 of the cartridge 200 mounted on the mount case 150 and through the contact 152. Further, the controller 130 updates the value of the cartridge remaining value stored in the memory of the IC chip 34 through the electrode 248 of the cartridge 200 mounted on the mount case 150 and through the contact 152.

Processing executed by the controller 130 will be described with reference to the flowcharts shown in FIGS. 7 to 9B. The execution order of the following processing may be changed as appropriate without departing from the scope of the present disclosure.

Print Processing

Figure 7:
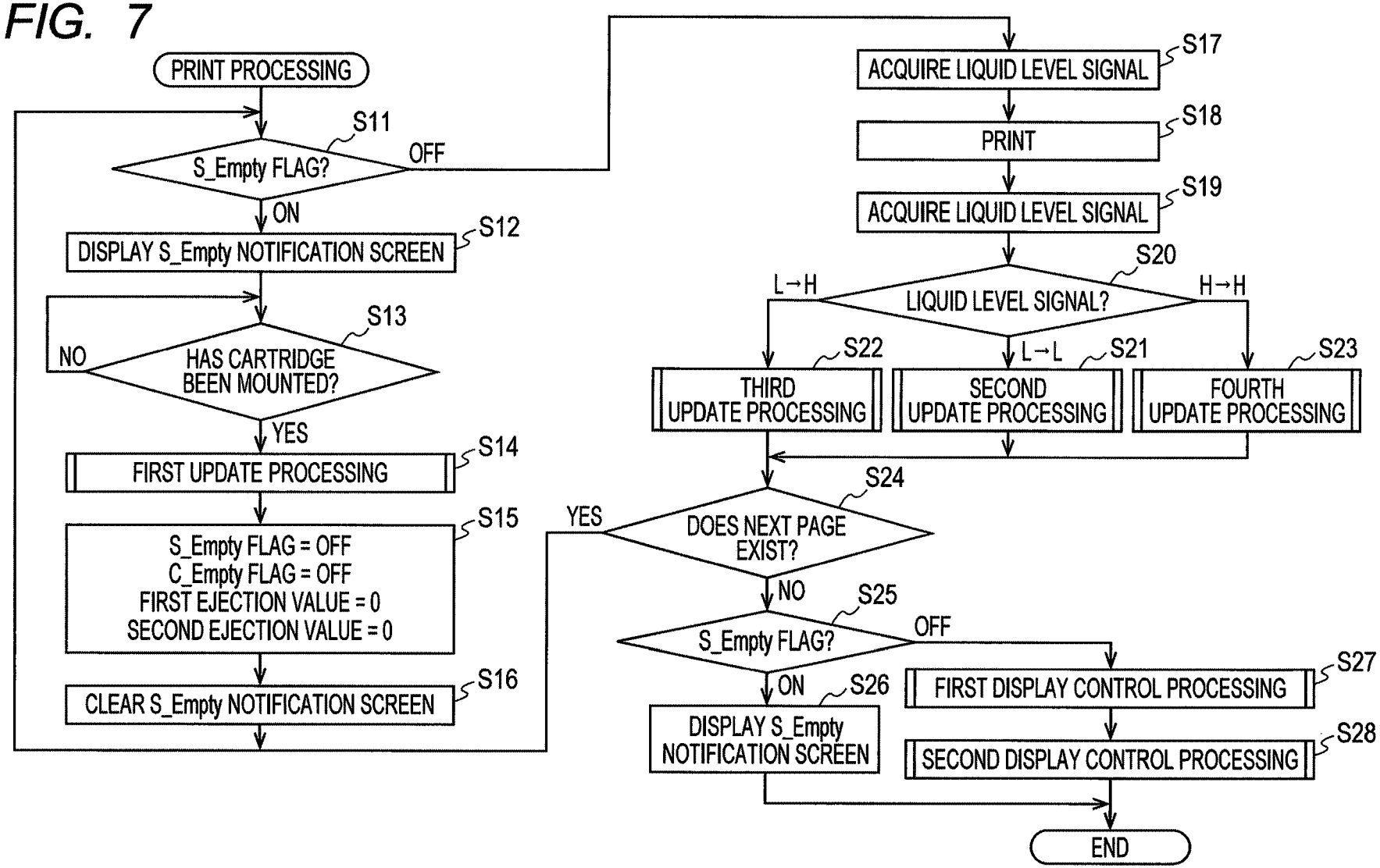
FIG. 7 is a flowchart of print processing.

The controller 130 executes the print processing shown in FIG. 7 in response to a print instruction being inputted to the printer 10. Although the acquisition source of the print instruction is not particularly limited, for example, a user operation corresponding to the print instruction may be received through the operation panel 22 or the display 28, or may be received from an external device through the communication interface 31. The print instruction is an example of an ejection instruction. The print instruction includes image data indicating an image. The image data is stored in the RAM 62 of the printer 10.

First, the controller 130 determines whether the value of an S_Empty flag stored in the EEPROM 61 is "ON" or "OFF" (step S11; step will be hereinafter abbreviated as "S"). The controller 130 stores "ON" in the S_Empty flag in the EEPROM 61 before the liquid level of the ink stored in the liquid chamber 171 of the tank 160 reaches the upper end of the outflow port 174 from which the ink flows out of the tank 160. The value of the S_Empty flag in the EEPROM 61 is "OFF" until "ON" is stored. If the ink level reaches the upper end of the outflow port 174, there is a risk that air enters the nozzles of the head 21. If the air that has entered the nozzles of the head 21 stays in the nozzles, there is a possibility that the ink is blocked from entering the nozzles or the ejection of ink droplets from the nozzles may be blocked.

That is, the S_Empty flag is for preventing air from entering the nozzles of the head 21. The controller 130 stores "OFF" in the S_Empty flag in the EEPROM 61 in S15 described later, and stores "ON" in the S_Empty flag in the EEPROM 61 in S65. In response to the value of the S_Empty flag in the EEPROM 61 being "ON", the controller 130 prohibits ink ejection through the head 21. The controller 130 allows ink to be ejected through the head 21 in response to the value of the S_Empty flag in the EEPROM 61 being "OFF". In the following description, it may be described that the tank 160 is in an ink empty state when the S_Empty flag is ON, and that the tank 160 is not in an ink empty state when the S_Empty flag is OFF. The processing of S11 is an example of prohibition processing.

In response to determining that the value of the S_Empty flag in the EEPROM 61 is "ON" (S11: ON), the controller 130 displays an S_Empty notification screen (not shown) on the display 28 (S12). The S_Empty notification screen is a screen for notifying the user that the corresponding tank 160 is in an ink empty state.

Next, the controller 130 acquires a mount signal from the mount sensor 32 at particular time intervals. Next, the controller 130 determines whether the acquired mount signal has changed from a low level signal (hereinafter referred to as "L") to a high level signal (hereinafter described as "H") and the acquired mount signal has changed from "H" to "L" (S13). That is, it is determined whether the cartridge 200 has been mounted based on a change in the mount signal. Hereinafter, a fact that the controller 130 determines whether the acquired mount signal has changed from "L" to "H" and the acquired mount signal has changed from "H" to "L" will be referred to as that "the controller 130 determines whether the cartridge 200 has been mounted". Further, a fact that the controller 130 determines that the acquired mount signal has changed from "L" to "H" and that the acquired mount signal has changed from "H" to "L" (S13: Yes) will be referred to as that "the controller 130 determines that the cartridge 200 has been mounted".

In response to determining that the cartridge 200 is not mounted (S13: No), the controller 130 continues to periodically acquire a mount signal from the mount sensor 32. In response to determining that the cartridge 200 has been mounted (S13: Yes), the controller 130 executes first update processing (S14). Although the processing of S13 has been described as a specific example in which the controller 130 determines whether the cartridge 200 has been mounted, the present disclosure is not limited thereto. For example, it may be determined whether the cartridge 200 has been mounted by using a serial number. The controller 130 reads the serial number of the cartridge 200 from the memory of the IC chip 34 of the cartridge 200. Then, the controller 130 determines whether the read serial number matches the serial number stored in the EEPROM 61. The serial number stored in the EEPROM 61 is a serial number stored in the memory of the IC chip 34 of the cartridge 200 that has been mounted on the mount case 150 before the new cartridge 200 is mounted on the mount case 150. In this case, in response to determining that the serial number read from the memory of the IC chip 34 does not match the serial number stored in the EEPROM 61, the controller 130 determines that the new cartridge 200 has been mounted.

First Update Processing

Figure 8A:
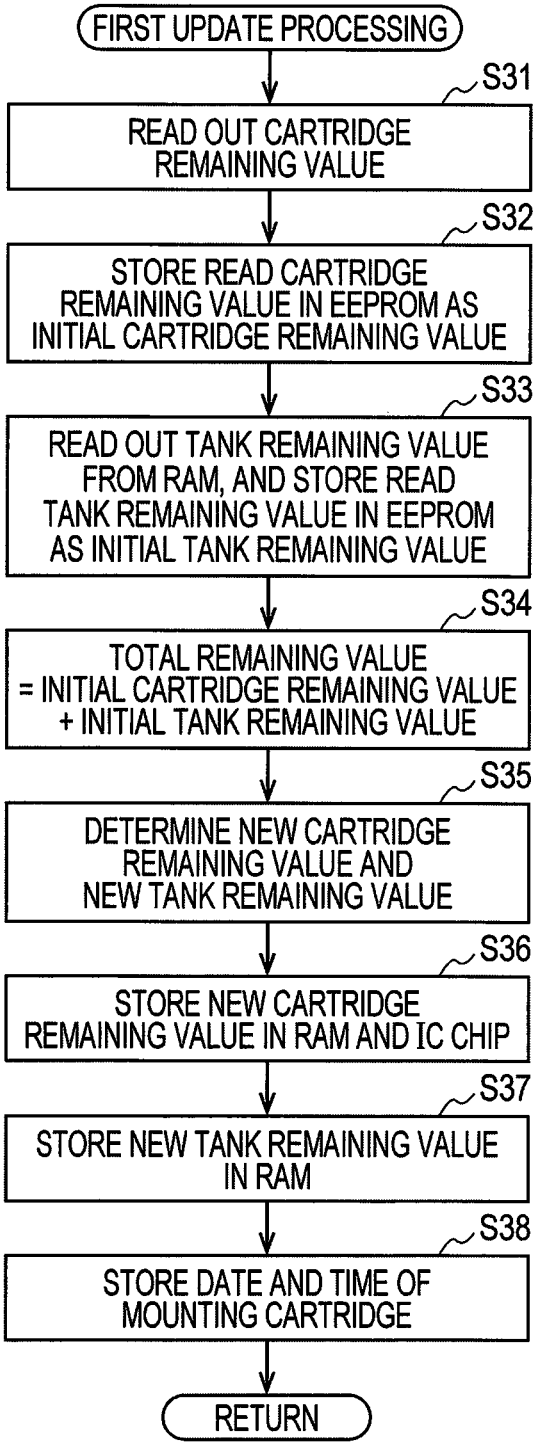
FIG. 8A is a flowchart of first update processing.

The first update processing shown in FIG. 8A is processing in which the controller 130 updates the initial cartridge remaining value and the initial tank remaining value stored in the EEPROM 61 and the cartridge remaining value stored in the IC chip 34 of the cartridge 200.

First, the controller 130 reads, through the contact 152, the cartridge remaining value stored in the memory of the IC chip 34 from the memory of the IC chip 34 of the cartridge 200 mounted on the mount case 150 (S31). The controller 130 stores the read cartridge remaining value in the EEPROM 61 as an initial cartridge remaining value (S32).

Further, the controller 130 reads out the tank remaining value from the RAM 62 (S33). The tank remaining value is a value indicating the amount of ink stored in the liquid chamber 171 of the tank 160. When the tank remaining value is not stored in the RAM 62 due to power off and so on, the controller 130 calculates the tank remaining value in the same manner as the fourth update processing described later, and stores the calculated tank remaining value in the RAM 62. The tank remaining value read from the RAM 62 is a value indicating the remaining amount of ink stored in the liquid chamber 171 of the tank 160 immediately before the cartridge 200 is mounted. In other words, the tank remaining value is a value indicating the remaining amount of ink stored in the liquid chamber 171 of the tank 160 when the cartridge 200 is removed. The controller 130 stores the tank remaining value read from the RAM 62 in the EEPROM 61 as an initial tank remaining value (S33).

The controller 130 adds the initial cartridge remaining value and the initial tank remaining value to calculate a total remaining value indicating the total remaining amount of ink (S34). The controller 130 determines a new cartridge remaining value and tank remaining value from the calculated total remaining value (S35).

More specifically, when a new cartridge 200 is mounted on the mount case 150, a part of the ink stored in the liquid chamber 210 flows out from the liquid chamber 210 of the cartridge 200 to the liquid chamber 171 of the tank 160. The outflow of ink from the liquid chamber 210 of the cartridge 200 to the liquid chamber 171 of the tank 160 is stopped when the difference between the head of ink stored in the liquid chamber 210 of the cartridge 200 and the head of ink stored in the liquid chamber 171 of the tank 160 becomes almost eliminated. The new cartridge remaining value and the new tank remaining value indicate the remaining amount of ink in a state where the difference between the head of the ink head stored in the liquid chamber 210 of the cartridge 200 and the head of the ink head stored in the liquid chamber 171 of the tank 160 becomes almost eliminated.

The cartridge remaining value and the tank remaining value may be determined, for example, by the controller 130 performing calculation based on a calculation formula stored in the EEPROM 61 or the ROM 37. Alternatively, the cartridge remaining value and the tank remaining value may be determined by the controller 130 based on a table stored in the EEPROM 61 or the ROM 37, for example. More specifically, the shape of the liquid chamber 210 of the cartridge 200 and the shape of the liquid chamber 171 of the tank 160 are determined in advance by design. Thus, if the total ink remaining value is known, the cartridge remaining value and the tank remaining value in a state where the difference between the ink head stored in the cartridge 200 and the ink head stored in the tank 160 is almost eliminated can be determined. The EEPROM 61 and the ROM 37 store in advance formulas for calculating the cartridge remaining value and the tank remaining value from the total remaining value. Alternatively, the EEPROM 61 and the ROM 37 store in advance a table showing the correspondence among the total remaining value, the cartridge remaining value, and the tank remaining value. The controller 130 determines a new cartridge remaining value and a new tank remaining value based on the total remaining ink value and the calculation formula or table.

The controller 130 stores the determined new cartridge remaining value in the RAM 62 and updates the cartridge remaining value stored in the memory of the IC chip 34 (S36). Further, the controller 130 stores the determined new tank remaining value in the RAM 62 (S37). Next, the controller 130 stores the date and time information output by the clock 30 in the EEPROM 61 as the mounted date and time (S38), and ends the first update processing.

As shown in FIG. 7, when the first update processing is completed (S14), the controller 130 stores "OFF" in the S_Empty flag in the EEPROM 61, stores "OFF" in the C_Empty flag in the EEPROM 61, and stores zero ("0") as the first ejection value and the second ejection value in the EEPROM 61 (S15). Then, the controller 130 clears (deletes) the S_Empty notification screen from the display 28 (S16). After executing the processing of S16, the controller 130 executes the processing of S11 again. The C_Empty flag, the first ejection value, and the second ejection value will be described later.

In response to determining that the value of the S_Empty flag in the EEPROM 61 is "OFF" (S11: OFF), the controller 130 acquires a signal (hereinafter referred to as a liquid level signal) from the liquid level sensor 33 (S17). Thereafter, the controller 130 performs printing on the sheet according to the image data stored in the RAM 62 (S18). The ink is ejected through the head 21 to print the image on the sheet. As the ink is ejected, the ink level in the tank 160 is lowered. After executing printing (S18), the controller 130 acquires a liquid level signal from the liquid level sensor 33 (S19). Next, the controller 130 performs determination on the liquid level signal acquired in S17 and the liquid level signal acquired in S19 (S20). Hereinafter, the low level signal acquired by the controller 130 from the liquid level sensor 33 may be described as "L", and the high level signal acquired by the controller 130 from the liquid level sensor 33 may be described as "H".

In response to determining that both of the liquid level signals acquired in S17 and S19 are "L" (S20: L->L), the controller 130 executes the second update processing (S21). In response to determining in S20 that both of the liquid level signals acquired in S17 and S19 are "L", the ink stored in the liquid chamber 171 of the tank 160 is in the following state. That is, the position of the liquid level of the ink stored in the liquid chamber 171 of the tank 160 before printing (S18) is higher than or equal to the reference position P (the liquid level signal acquired in S17 is "L"). The position of the liquid level of the ink stored in the liquid chamber 171 of the tank 160 after printing (S18) is higher than or equal to the reference position P (the liquid level signal acquired in S19 is "L"). That is, after printing (S18), ink is present in the liquid chamber 210 of the cartridge 200 when the liquid level signal acquired by the controller 130 in S19 is "L".

Second Update Processing

Figure 8B:
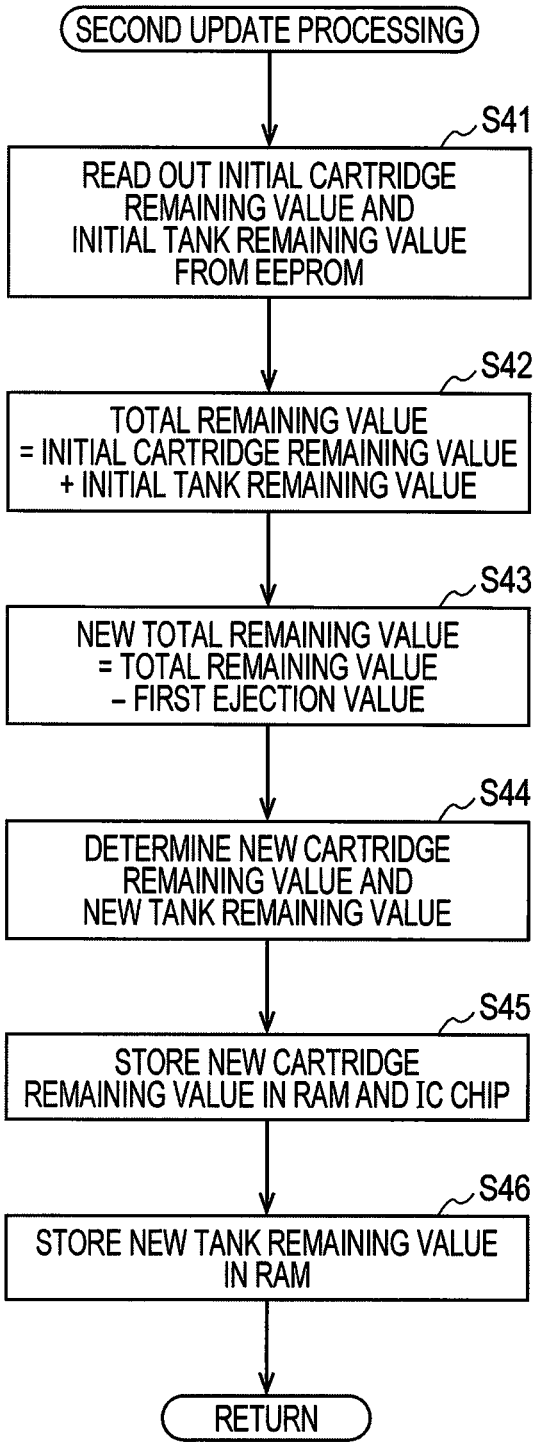
FIG. 8B is a flowchart of second update processing.

The second update processing shown in FIG. 8B is processing in which the controller 130 determines new cartridge remaining value and tank remaining value from the first ejection value indicating the amount of ink ejected through the head 21 during printing and maintenance. The first ejection value is, for example, a value obtained by multiplying the amount of one ink droplet to be ejected by the head 21 by the number of times one ink droplet is ejected. Each time the controller 130 instructs the head 21 to eject ink, the controller 130 counts the first ejection value according to the instruction. The controller 130 counts the first ejection value corresponding to the amount ejected by the head 21 from the mounting of the cartridge 200 to the present. That is, the first ejection value is the cumulative value of the amount of ink ejected by the head 21 from the mounting of the cartridge 200 to the present. The first ejection value is stored in the EEPROM 61. The first ejection value is an example of an ejection amount.

First, the controller 130 reads out the initial cartridge remaining value and the initial tank remaining value from the EEPROM 61 (S41). Next, the controller 130 calculates the total remaining value by adding the read initial cartridge remaining value and initial tank remaining value (S42). The controller 130 subtracts the first ejection value from the calculated total remaining value to calculate a new total remaining value (S43). Thereafter, the controller 130 determines a new cartridge remaining value and a new tank remaining value by using the calculation formula or the table in the same manner as described above (S44).

The controller 130 stores the determined new cartridge remaining value in the RAM 62 and updates the cartridge remaining value stored in the IC chip 34 (S45). Further, the controller 130 stores the determined new tank remaining value in the RAM 62 (S46), and ends the second update processing.

The method for determining the cartridge remaining value and the tank remaining value described above is one example, and the cartridge remaining value and the tank remaining value may be determined by another method.

In response to determining that the value of the S_Empty flag in the EEPROM 61 is "OFF" (S11: OFF), the controller 130 executes the processing from S17 to S20 again. In response to determining that the liquid level signal acquired in S17 is "L" and the liquid level signal acquired in S19 is "H" (S20: L->H), third update processing (S22) is executed. In a case where the controller 130 determines in S20 that the liquid level signal acquired in S17 is "L" and that the liquid level signal acquired in S19 is "H", the ink stored in the liquid chamber 171 of the tank 160 is in the following state. That is, the position of the liquid level of the ink stored in the liquid chamber 171 of the tank 160 before printing (S18) is higher than or equal to the reference position P (the liquid level signal acquired in S17 is "L"). The position of the liquid level of the ink stored in the liquid chamber 171 of the tank 160 after printing (S18) is lower than the reference position P (the liquid level signal acquired in S19 is "H"). That is, the ink in the liquid chamber 210 of the cartridge 200 is gone during printing (S18). In other words, it means that the ink stored in the liquid chamber 210 of the cartridge 200 has been used up during printing (S18).

Third Update Processing

Figure 8C:
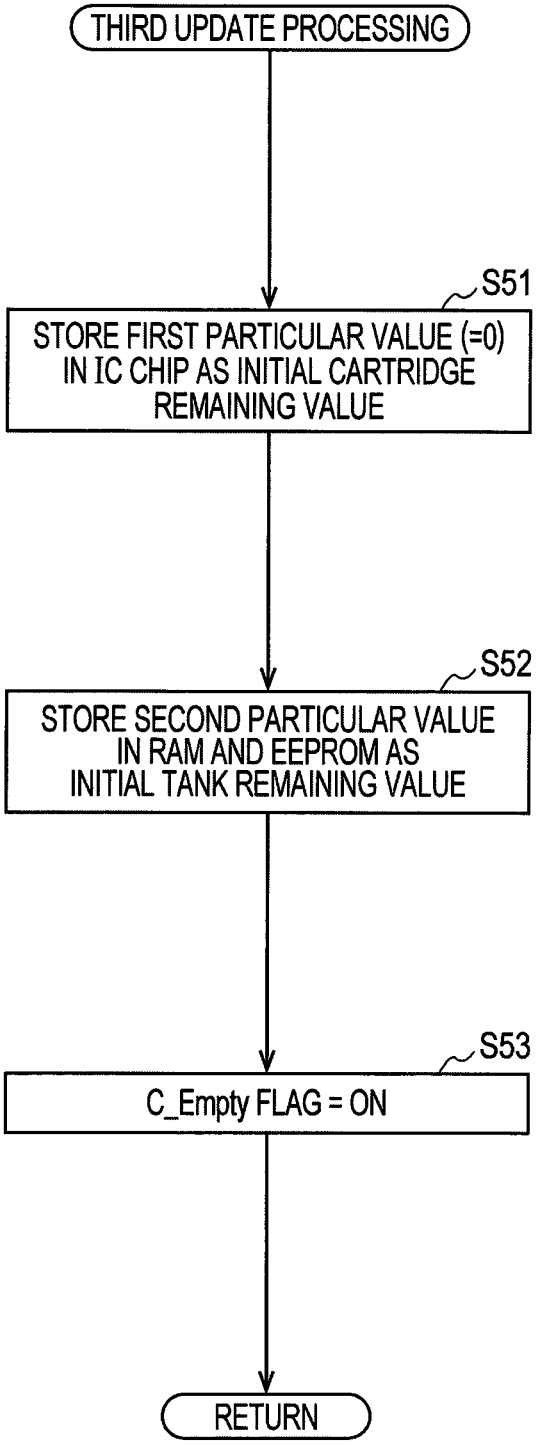
FIG. 8C is a flowchart of third update processing.

The third update processing shown in FIG. 8C is processing in which the controller 130 updates the initial cartridge remaining value to a first particular value and updates the initial tank remaining value to a second particular value. More specifically, the first ejection value indicating the amount of ink ejected through the head 21 by printing and so on includes an error. For example, even if the controller 130 instructs the head 21 to eject a specific amount of ink, there may be a difference between the amount of ink actually ejected from the head 21 and the specific amount instructed to the head 21. This difference may occur due to the temperature when the ink ejection is instructed, for example. This is because the lower the temperature, the higher the viscosity of the ink, making it difficult for the ink to be ejected through the nozzles 29. Further, when the controller 130 repeatedly instructs the head 21 to perform the above-described instruction, the difference between the amount of ink actually ejected through the head 21 and the amount obtained by repeating a specific amount may be further increased. That is, every time printing is performed, an error may be accumulated between the amount indicated by the calculated first ejection value and the amount actually ejected through the head 21.

Since the cartridge remaining value is determined according to the first ejection value, an error occurs between the ink remaining amount indicated by the cartridge remaining value and the actual ink remaining amount stored in the liquid chamber 210. Further, since the tank remaining value is determined according to the first ejection value, an error occurs between the ink remaining amount indicated by the tank remaining value and the actual ink remaining amount stored in the liquid chamber 171. Thus, the cartridge remaining value and the tank remaining value that are determined each time printing is performed include an accumulated error. The third update processing is processing for resetting the accumulated error.

More specifically, the controller 130 updates the initial cartridge remaining value stored in the memory of the IC chip 34 with the first particular value (S51). The first particular value is "zero", for example. Further, the controller 130 stores the second particular value in the RAM 62 and the EEPROM 61 as the initial tank remaining value (S52). The second particular value is a value indicating the amount of ink stored in the liquid chamber 171 of the tank 160 when the ink level is at the reference position P. The first particular value and the second particular value are stored in advance in the ROM 37, for example.

Next, the controller 130 stores "ON" in the C_Empty flag in the EEPROM 61 (S53). The C_Empty flag is information indicating whether the cartridge 200 is in a cartridge empty state. The C_Empty flag has either a value "ON" corresponding to a cartridge empty state or a value "OFF" corresponding to a cartridge non-empty state. The cartridge empty state is a state in which ink is not substantially stored in the cartridge 200 (more specifically, the liquid chamber 210). In other words, the cartridge empty state is a state in which the ink does not move from the liquid chamber 210 to the liquid chamber 171 in communication. In other words, the cartridge empty state is a state in which the liquid level of the tank 160 communicated with the cartridge 200 is lower than the reference position P. Then, the controller 130 ends the third update processing.

In response to determining in S11 that the value of the S_Empty flag in the EEPROM 61 is "OFF" (S11: OFF), the controller 130 executes S17 to S20 again. In response to determining that both of the liquid level signals acquired in S17 and S19 are "H" (S20: H->H), the controller 130 executes fourth update processing (S23). In a case where it is determined in S20 that both of the liquid level signals acquired in S17 and S19 are "H", the ink stored in the liquid chamber 171 of the tank 160 is in the following state. That is, the position of the liquid level of the ink stored in the liquid chamber 171 of the tank 160 before printing (S18) is lower than the reference position P (the liquid level signal acquired in S17 is "H"). The position of the liquid level of the ink stored in the liquid chamber 171 of the tank 160 after printing (S18) is lower than the reference position P (the liquid level signal acquired in S19 is "H"). That is, before and after the execution of printing (S18), the controller 130 determines that no ink is present in the liquid chamber 210 of the cartridge 200.

Fourth Update Processing

Figure 8D:
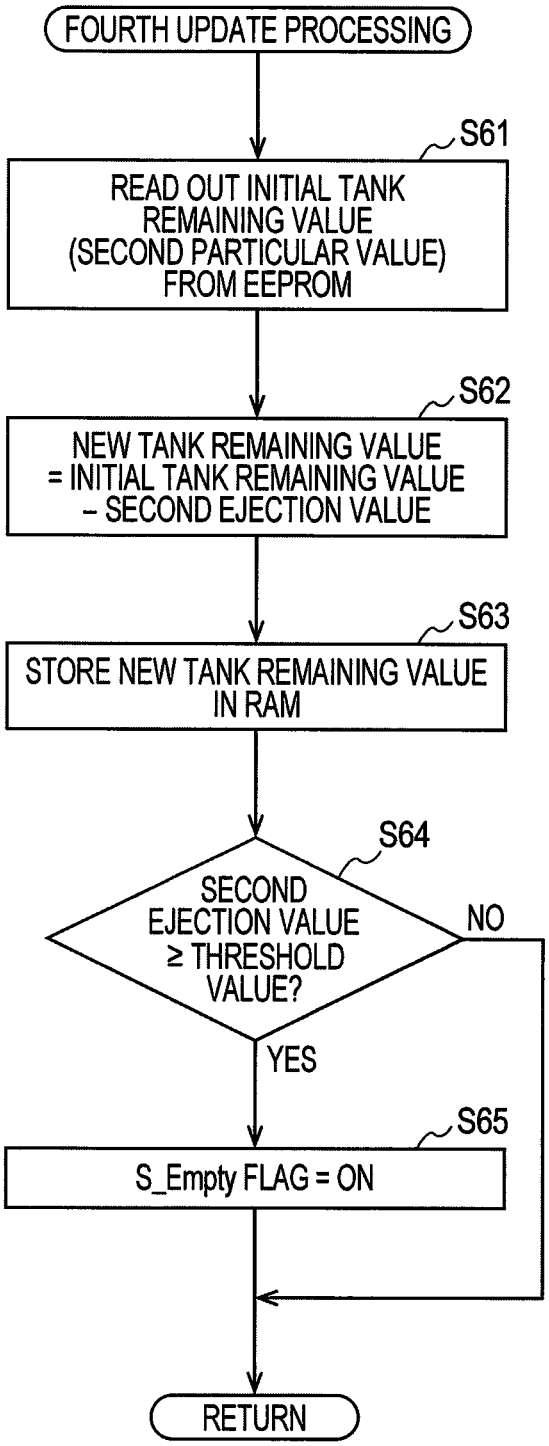
FIG. 8D is a flowchart of fourth update processing.

The fourth update processing shown in FIG. 8D is processing in which the controller 130 calculates a tank remaining value and further determines whether to prohibit printing. First, the controller 130 reads out the initial tank remaining value updated to the second particular value from the EEPROM 61 (S61). The controller 130 subtracts the second ejection value from the read initial tank remaining value to calculate a new tank remaining value (S62). Similar to the first ejection value, the second ejection value is, for example, a value obtained by multiplying the amount of one droplet of ink ejected by the head 21 by the number of times that one droplet of ink is ejected. Each time the controller 130 instructs the head 21 to eject ink, the controller 130 counts the second ejection value according to the instruction. The controller 130 counts the second ejection value indicating the amount of ink ejected by the head 21 to the present after the liquid level signal acquired from the liquid level sensor 33 changes from "L" to "H". That is, the second ejection value is the cumulative value of the amount of ink ejected by the head 21 from when the liquid level signal acquired from the liquid level sensor 33 changes from "L" to "H" to the present. The second ejection value is stored in the EEPROM 61. The second ejection value is an example of an ejection amount.

The controller 130 stores the calculated new tank remaining value in the RAM 62 (S63). Next, the controller 130 determines whether the counted second ejection value has reached a threshold value (S64). The threshold value is a value stored in advance in the ROM 37 or the EEPROM 61. In response to determining that the counted second ejection value has not reached the threshold value (S64: No), the controller 130 ends the fourth update processing. In response to determining that the counted second ejection value has reached the threshold value (S64: Yes), the controller 130 stores "ON" in the S_Empty flag in the EEPROM 61 (S65), and ends the fourth update processing. In response to determining that "ON" is stored in the S_Empty flag in the EEPROM 61, the controller 130 prohibits ink ejection through the head 21 including printing and maintenance. The processing of S64 is an example of fifth determination processing.

The threshold value is set such that the liquid level of the ink stored in the liquid chamber 171 of the tank 160 is slightly above the outflow port 174 when the second ejection value reaches the threshold value. More specifically, there may be an error between the design reference position P to be detected by the liquid level sensor 33 and the reference position P actually detected by the liquid level sensor 33. This error may occur due to, for example, malfunction of the actuator 190 and so on. The threshold value is set such that, even if the error is the maximum error that can be assumed at the time of design, when the second ejection value reaches the threshold, the liquid level of the ink stored in the liquid chamber 171 of the tank 160 does not overlap the outflow port 174. The controller 130 prohibits the ink from being ejected through the head 21, thereby preventing air from entering the head 21. In addition to the above-described error, by taking into account that the printer 10 is placed on an inclined surface, the threshold value may be set such that, even if the printer 10 is placed on a surface with a particular inclination angle, the liquid level of the ink stored in the liquid chamber 171 of the tank 160 does not overlap the outflow port 174 when the second ejection value reaches the threshold value. Further, the second ejection value may include an error as with the first ejection value. The threshold value may be set such that, even if the error of the second ejection value is the maximum, the liquid level of the ink stored in the liquid chamber 171 of the tank 160 does not overlap the outflow port 174 when the second ejection value reaches the threshold. The remaining amount of ink in the liquid chamber 171 of the tank 160 when the second ejection value reaches the threshold value is an example of a fourth liquid amount.

As shown in FIG. 7, when the second update processing (S21), the third update processing (S22), or the fourth update processing (S23) ends, the controller 130 determines whether the next page is stored in the RAM 62 (S24). In response to determining that the next page is stored in the RAM 62 (S24: Yes), the controller 130 executes the processing of S11 again.

In response to determining that the next page is not stored in the RAM 62 (S24: No), the controller 130 determines whether the value of the S_Empty flag stored in the EEPROM 61 is "ON" or "OFF" (S25). In response to determining that the value of the S_Empty flag in the EEPROM 61 is "ON" (S25: ON), the controller 130 displays the S_Empty notification screen on the display 28 (S26) and ends the print processing. The S_Empty notification screen displayed in S26 may be the same as S12.

In response to determining that the value of the S_Empty flag is "OFF" (S25: OFF), the controller 130 executes first display control processing (S27) and second display control processing (S28), which will be described later, and ends the print processing. The first display control processing is processing for controlling the display 28 to display a C_Empty notification screen. The second display control processing is processing for deleting the C_Empty notification screen from the display 28.

As described above, each time the printing in S18 is executed, the controller 130 determines the cartridge remaining value and the tank remaining value in accordance with the amount of ink used for printing. In the above-described processing, which the controller 130 determines the cartridge remaining value and the tank remaining value each time printing for one page is performed. Instead of this, the controller 130 may determine the cartridge remaining value and the tank remaining value each time printing for one pass is performed. The controller 130 executes the second update processing, the third update processing, and the fourth update processing every time ink is ejected through the head 21 not only for printing but also for maintenance. The instruction for performing maintenance is an example of an ejection instruction.

First Display Control Processing

Next, with reference to FIG. 9A, details of the first display control processing executed by the controller 130 in S27 of the print processing will be described. The first display control processing is processing for controlling the display 28 to display the C_Empty notification screen.

First, the controller 130 acquires the values of four C_Empty flags of black, magenta, cyan, and yellow (S81).

Next, the controller 130 determines whether at least one of the four C_Empty flags acquired in S81 is "ON" (S82). In response to determining that all the four C_Empty flags acquired in S81 are "OFF" (S82: No), the controller 130 ends the first display control processing. The processing of S82 is an example of first determination processing.

In response to determining that at least one of the four C_Empty flags acquired in S81 is "ON" (S82: Yes), the controller 130 reads out the remaining values of the four tanks 160 for black, magenta, cyan, and yellow from the RAM 62 (S83).

Next, the controller 130 determines whether at least one of the tank remaining values read in S83 is smaller than or equal to the first particular remaining value (S84). In response to determining that all the four tank remaining values read in S83 are larger than the first particular remaining value (S84: No), the controller 130 reads out the cartridge remaining values of the four cartridges 200 of black, magenta, cyan, and yellow from the RAM 62 (S85). The processing of S84 is an example of fourth determination processing.

The first particular remaining value is set such that, when the tank remaining value reaches the first particular remaining value, the liquid level of the ink stored in the liquid chamber 171 of the tank 160 is slightly above the liquid level when the second ejection value reaches the threshold value. The first particular remaining value is stored in advance in the ROM 37 or the EEPROM 61. For example, the first particular remaining value is set such that printing for twenty pages of image data can be performed after the tank remaining value reaches the first particular remaining value and before the second ejection value reaches the threshold value, or such that printing for two days can be performed during that period. The remaining amount of ink in the liquid chamber 171 of the tank 160 when the tank remaining value reaches the first particular remaining value is an example of a third liquid amount.

Next, the controller 130 determines whether, among four colors, there is at least one color for which the C_Empty flag acquired in S81 is "OFF" and the cartridge remaining value read in S85 is smaller than or equal to the second particular remaining value (S86). In response to determining that there is at least one such color (S86: Yes), the controller 130 ends the first display control processing. The processing in S86 is an example of second determination processing.

The second particular remaining value is set such that, when the cartridge remaining value reaches the second particular remaining value, the liquid level of the ink stored in the liquid chamber 210 of the cartridge 200 is slightly above the liquid level of the ink stored in the liquid chamber 210 of the cartridge 200 when the liquid level of ink stored in the liquid chamber 171 of the tank 160 is at the reference position P. The second particular remaining value is stored in advance in the ROM 37 or the EEPROM 61. For example, the second particular remaining value is set such that the time until the ink in the liquid chamber 210 of the cartridge 200 runs out after the cartridge remaining value of the cartridge 200 reaches the second particular remaining value is shorter than the time from when the position of the liquid level of the ink stored in the chamber 171 of the tank 160 reaches the reference position P until the tank remaining value of the tank 160 reaches the first particular remaining value.

Figure 6B:
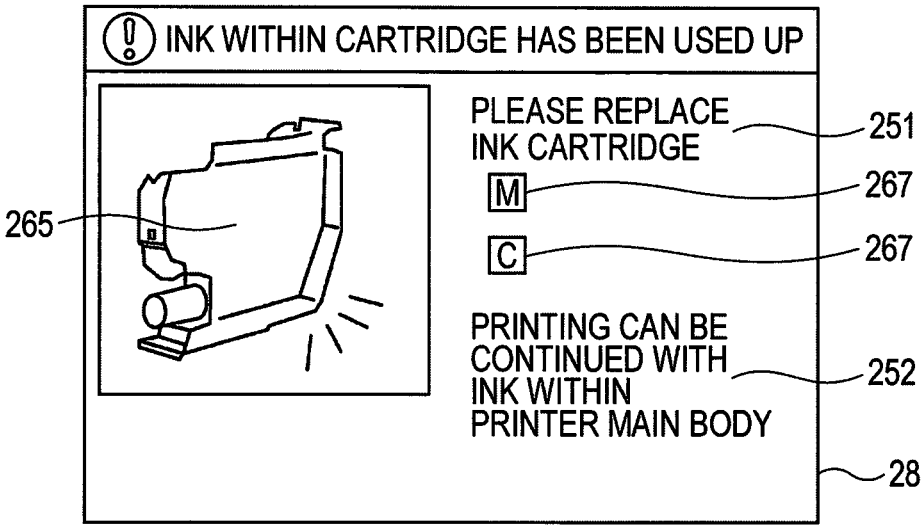
FIG. 6B is a diagram showing a C_Empty notification screen.

In response to determining in S84 that at least one of the four tank remaining values is smaller than or equal to the first particular remaining value (S84: Yes) or determining in S86 that, among the four colors, there is no color for which the C_Empty flag is "OFF" and the cartridge remaining value is smaller than or equal to the second particular remaining value (S86: No), the controller 130 controls the display 28 to display the C_Empty notification screen (see FIG. 6B) (S87), and ends the first display control processing.

The C_Empty notification screen is a screen for notifying the user that the cartridge 200 corresponding to the C_Empty flag for which "ON" is set is in a cartridge empty state. The C_Empty notification screen shown in FIG. 6B includes an object 251, an object 252, an object 265, and objects 267.

The object 251 is an object for prompting replacement of the cartridge 200. In the illustrated example, the object 251 is composed of characters "Please replace ink cartridge(s)". The object 252 is an object that allows the user to recognize that printing can be continued. In the example shown in FIG. 6B, the object 252 is made up of characters "Printing can be continued with ink in the main body". The object 265 is an object indicating the empty cartridge 200. The object 265 allows the user to intuitively recognize that there is a cartridge 200 that has run out of ink.

The objects 267 are objects indicating the type (color) of cartridge 200 to be replaced. In the illustrated example, the C_Empty notification screen includes the object 267 composed of a letter "M" representing magenta and the object 267 composed of a letter "C" representing cyan. When the cartridge 200 of the replacement target is the cartridge 200 in which yellow ink is stored, the object 267 having a letter "Y" is displayed on the C_Empty notification screen. When the cartridge 200 of the replacement target is the cartridge 200 in which black ink is stored, the object 267 having a letter "B" is displayed on the C_Empty notification screen.

The controller 130 causes the C_Empty notification screen to display the object 267 indicating the cartridge 200 (an example of a first cartridge) of the color for which it is determined in S82 that the C_Empty flag is "ON" (S87). Here, the cartridge 200 includes the cartridge 200 (an example of a second cartridge) for which it is determined in S82 that the C_Empty flag is "OFF", it is determined in S86 that the cartridge remaining value is smaller than or equal to the second particular remaining value, and it is determined in S82 of the first display control processing thereafter that the C_Empty flag is "ON". The object 267 is an example of a first object. The C_Empty notification screen is an example of a first screen. The processing of S87 is an example of first display processing.

Further, the controller 130 causes the C_Empty notification screen to display the object 267 indicating the cartridge 200 (an example of the first cartridge) of the color for which it is determined in S82 that the C_Empty flag is "ON" and the object 267 indicating the cartridge 200 (an example of a third cartridge) of the color for which it is determined in S84 that the tank remaining value is smaller than the first particular remaining amount (S87). The object 267 is an example of a second object. The C_Empty notification screen is an example of a second screen. The processing of S87 is an example of second display processing.

The first display control processing described above is repeatedly executed every time print processing is executed, for example. For the color cartridge 200 (an example of a second cartridge) for which it is determined in S86 that the C_Empty flag is "OFF" and that the cartridge remaining value is smaller than or equal to the second particular remaining value, it is determined in S82 of the first display control processing thereafter whether the C_Empty flag is "ON". The processing of S82 is an example of third determination processing.

In the present embodiment, in response to determining in S86 that there is no color for which the C_Empty flag is "OFF" and the cartridge remaining value is smaller than or equal to the second particular remaining value (S86: No), the controller 130 controls the display 28 to display the C_Empty notification screen (see FIG. 6B) indicating that the cartridge 200 is to be replaced (S87). That is, in the present embodiment, with respect to all the cartridges 200 (an example of the second cartridge) of the color for which it is determined in S86 of the first display control processing executed previously that the C_Empty flag is "OFF" and that the cartridge remaining value is smaller than or equal to the second particular remaining value, when the stored ink is reduced and the liquid level signals of all the colors become "H" (S82: Yes and S86: No), the C_Empty notification screen is displayed on the display 28 (S87).

Second Display Control Processing

Next, with reference to FIG. 9B, details of the second display control processing executed by the controller 130 in S28 of the print processing will be described. The second display control processing is processing for deleting the C_Empty notification screen from the display 28.

First, in a similar manner to S11 of the print processing, the controller 130 determines whether each of the four cartridges 200 is mounted (S91). In response to determining that none of the cartridges 200 is mounted (S91: No), the controller 130 ends the second display control processing.

In response to determining that at least one of the four cartridges 200 is mounted (S91: Yes), the controller 130 reads out the tank remaining values of the four tanks 160 from the RAM 62 (S92).

Next, the controller 130 determines whether at least one of the tank remaining values read in S92 is smaller than or equal to the first particular remaining value (S93). In response to determining that at least one of the tank remaining values is smaller than or equal to the first particular remaining value (S93: Yes), the controller 130 determines whether the color of the cartridge 200 determined to be installed in S91 is the same as the color of the tank remaining value determined to be smaller than the first particular remaining value in S93 (S94). In response to determining that they are not the same (S94: No), the controller 130 ends the second display control processing. The processing in S91 and S94 is an example of sixth determination processing.

In response to determining in S93 that all the tank remaining values are larger than the first particular remaining value (S93: No) or determining in S94 that the colors are the same (S94: Yes), the controller 130 clears the C_Empty notification screen displayed on the display 28 in S87 (S95), and ends the second display control processing. The processing of S95 is an example of display end processing.

Note that the second display control processing may be periodically executed while the C_Empty notification screen is displayed, instead of or in addition to after the execution of the first display control processing.

In the second display control processing described above, even when all of the replacement target cartridges 200 displayed on the C_Empty notification screen have not been replaced, the controller 130 executes the processing of S95 to clear the C_Empty notification screen. A specific example will be described below.

It is assumed that the tank remaining value of black is smaller than the first particular remaining value, and the liquid level signal of magenta is "H" and the tank remaining value of magenta is larger than or equal to the first particular remaining value. In S87 of the first display control processing, the controller 130 controls the display 28 to display the C_Empty notification screen including the object 267 indicating black and magenta. The black cartridge 200 is an example of a third cartridge. The magenta cartridge 200 is an example of a second cartridge.

It is assumed that only the black cartridge 200 has been replaced by the user. The controller 130 determines that the cartridge is mounted in S91 of the second display control processing (S91: Yes), and determines in S93 that there is a tank remaining value (black) that is smaller than the first particular remaining value (S93: Yes), and determines in S94 that the color (black) of the cartridge 200 determined to be mounted in S91 is the same as the color (black) of the cartridge 200 having the tank remaining value determined to be smaller than the first particular remaining value in S93 (S94: Yes). The controller 130 executes the processing of S95 to clear the C_Empty notification screen. The magenta cartridge 200 that has not been replaced is an example of a fourth cartridge.

It is assumed that printing is performed thereafter, and cyan and yellow are in a state where the liquid level signal is "H" and the tank remaining value is larger than or equal to the first particular remaining value. The cyan and yellow cartridges 200 are examples of a second cartridge. The controller 130 executes first display control processing. The controller 130 determines in S82 that at least one of the liquid level signals is "H" (S82: Yes), determines in S84 that all the tank remaining values are larger than or equal to the first particular remaining value (S84: No), and determines in S86 that there is no color for which the liquid level signal is "L" and the cartridge remaining value is smaller than or equal to the second particular remaining value (S86: No). The controller 130 executes the processing of S87 to display the C_Empty notification screen on the display 28. The C_Empty notification screen includes the object 267 that prompts replacement of the magenta, cyan, and yellow cartridges 200. The object 267 is an example of a third object. The C_Empty notification screen is an example of a third screen. The processing in S87 is an example of third display processing.

Effects of the Present Embodiment

In the present embodiment, in a case where it is determined that the position of the liquid level of the tank 160 of a certain color is lower than the reference position P and that there is a cartridge 200 of another color for which the cartridge remaining value is smaller than or equal to the second particular remaining amount, the controller 130 controls the display 28 to display the C_Empty notification screen prompting replacement of both cartridges 200 at the time when it is determined that the position of the liquid level of the tank 160 of that color is lower than the reference position P. That is, in a case where there is a cartridge 200 of the color for which the cartridge remaining value is smaller than or equal to the second particular remaining value and the position of the liquid level in the tank 160 will soon reach the reference position P, without performing the replacement display immediately, at the time when the position of the liquid level in the tank 160 reaches the reference position P, the C_Empty notification screen is displayed on the display 28 all at once (all together). Thus, the user can replace a plurality of cartridges 200 at a time. Consequently, the trouble of replacing the cartridge 200 can be reduced.

Further, if the replacement instruction for one cartridge 200 is displayed and the cartridge 200 is replaced and then the replacement instruction for another cartridge 200 is displayed soon and the cartridge 200 is replaced, it is necessary to wait for the inflow (filling) of ink twice. According to the present embodiment, in a case where there is a cartridge 200 having the cartridge remaining value smaller than or equal to the second particular remaining value, the replacement display is not performed immediately but, at the time it is determined that the replacement instruction is displayed for the cartridge 200, the replacement display is performed together at once. Since the plurality of cartridges 200 are replaced together, the waiting time for the inflow of ink accompanying the replacement of the cartridges 200 can be reduced, as compared with the case where the replacement of the cartridges 200 is performed successively (separately).

In this embodiment, in response to determining that the liquid level signal is "H" for all the second cartridges (S82: Yes and S86: No), the controller 130 performs replacement display together at once for all the second cartridges and the first cartridges (S87). Consequently, the trouble of replacing the cartridge 200 can be further reduced.

In this embodiment, in response to determining that at least one of the tank remaining values is smaller than or equal to the first particular remaining value (S84: Yes), the controller 130 controls the display 28 to display the C_Empty notification screen regardless of whether there is a color for which the cartridge remaining value is smaller than or equal to the second particular remaining value (S86). Thus, a screen prompting the replacement of the cartridge 200 is displayed before the ink in the tank 160 runs out. Consequently, a situation where the ink in the tank 160 runs out can be avoided.

In the present embodiment, in response to determining that the second ejection value has reached the threshold value (S64: Yes->S65), the controller 130 prohibits ink ejection through the head 21. With this operation, a situation where the ink in the tank 160 runs out can be avoided.

In this embodiment, the controller 130 clears the C_Empty notification screen (S95) when the color cartridge 200 for which it is determined that the tank remaining value is smaller than or equal to the first particular remaining value is replaced (S94: Yes). Regarding the cartridge 200 that has not been replaced, when the C_Empty notification screen is next displayed on the display 28, a display prompting replacement of that cartridge 200 is included in the C_Empty notification screen (S87). That is, in a case where there is a cartridge 200 that has not been replaced, a replacement instruction is displayed together when another cartridge 200 is replaced. Consequently, the trouble of replacing the cartridge 200 can be further reduced.

In the present embodiment, the controller 130 determines whether at least one of the C_Empty flags is "ON" in S81.

When the C_Empty flag is "ON", the signal outputted from the liquid level sensor 33 is "H", the liquid level of the ink stored in the liquid chamber 171 of the tank 160 is lower than the reference position P, and ink is not substantially stored in the liquid chamber 210 of the cartridge 200 in this state. Thus, determining whether the C_Empty flag is "ON" is equivalent to determining whether the remaining amount of ink in the liquid chamber 210 of the cartridge 200 is smaller than a particular liquid amount (an example of a first liquid amount).

In the present embodiment, the controller 130 determines in S86 whether the cartridge remaining value is smaller than or equal to the second particular remaining value. The cartridge remaining value is a value indicating the amount of ink stored in the liquid chamber 210 of the cartridge 200. Thus, determining whether the cartridge remaining value is smaller than or equal to the second particular remaining value is equivalent to determining whether the remaining amount of ink in the liquid chamber 210 of the cartridge 200 is smaller than a particular liquid amount (an example of a second liquid amount).

In the present embodiment, the controller 130 determines in S84 whether at least one of the tank remaining values is smaller than or equal to the first particular remaining value. The tank remaining value is a value indicating the amount of ink stored in the liquid chamber 171 of the tank 160. Thus, determining whether the tank remaining value is smaller than or equal to the first particular remaining value is equivalent to determining whether the remaining amount of ink in the liquid chamber 171 of the tank 160 is smaller than a particular liquid amount (an example of a third liquid amount).

In the present embodiment, the controller 130 determines whether the second ejection value has reached the threshold value in S64. The second ejection value is the cumulative value of the amount of ink ejected by the head 21 from when the liquid level signal acquired from the liquid level sensor 33 changes from "L" to "H" to the present. The tank remaining value is a value obtained by subtracting the second ejection value from the tank remaining value corresponding to the amount of ink in the liquid chamber 171 when the liquid level signal changes from "L" to "H". Thus, the second ejection value is a value relating to the amount of ink in the liquid chamber 171 of the tank 160. Therefore, determining whether the second ejection value has reached the threshold value is equivalent to determining whether the remaining amount of ink in the liquid chamber 171 of the tank 160 is smaller than a particular liquid amount (an example of a fourth liquid amount).

Modification

While the disclosure has been described in detail with reference to the above aspects thereof, it would be apparent to those skilled in the art that various changes and modifications may be made therein without departing from the scope of the claims.

In the above embodiment, the controller 130 performs the first display control processing and the second display control processing based on the liquid level signal from the liquid level sensor 33 and the tank remaining value and the cartridge remaining value stored in the RAM 62. In the present modification, the controller 130 executes the first display control processing and the second display control processing based on a new total remaining value calculated in fifth update processing (FIG. 10B). In other words, in the present modification, the printer 10 need not include the liquid level sensor 33.

Figure 9A:
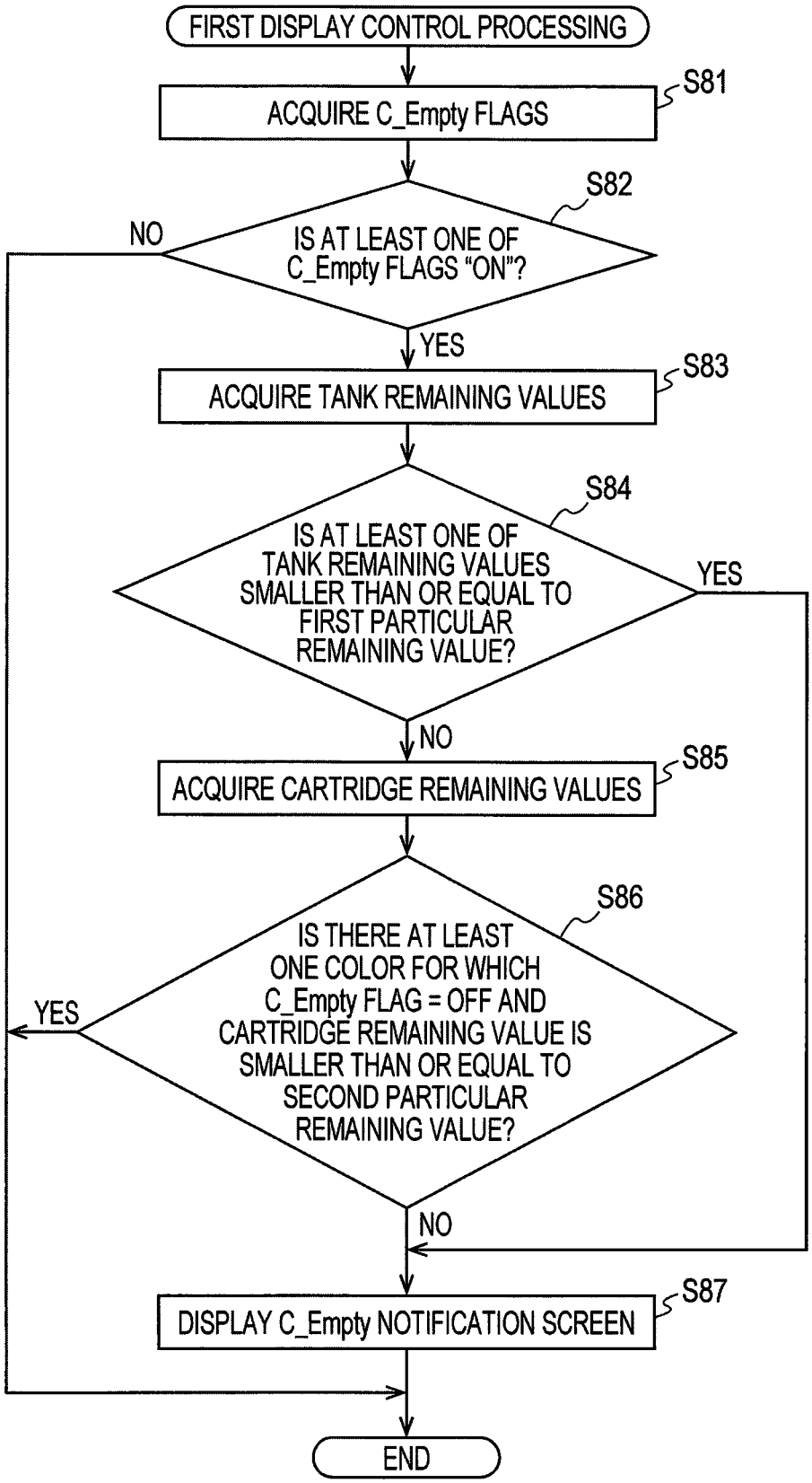
FIG. 9A is a flowchart of first display control processing.
Figure 9B:
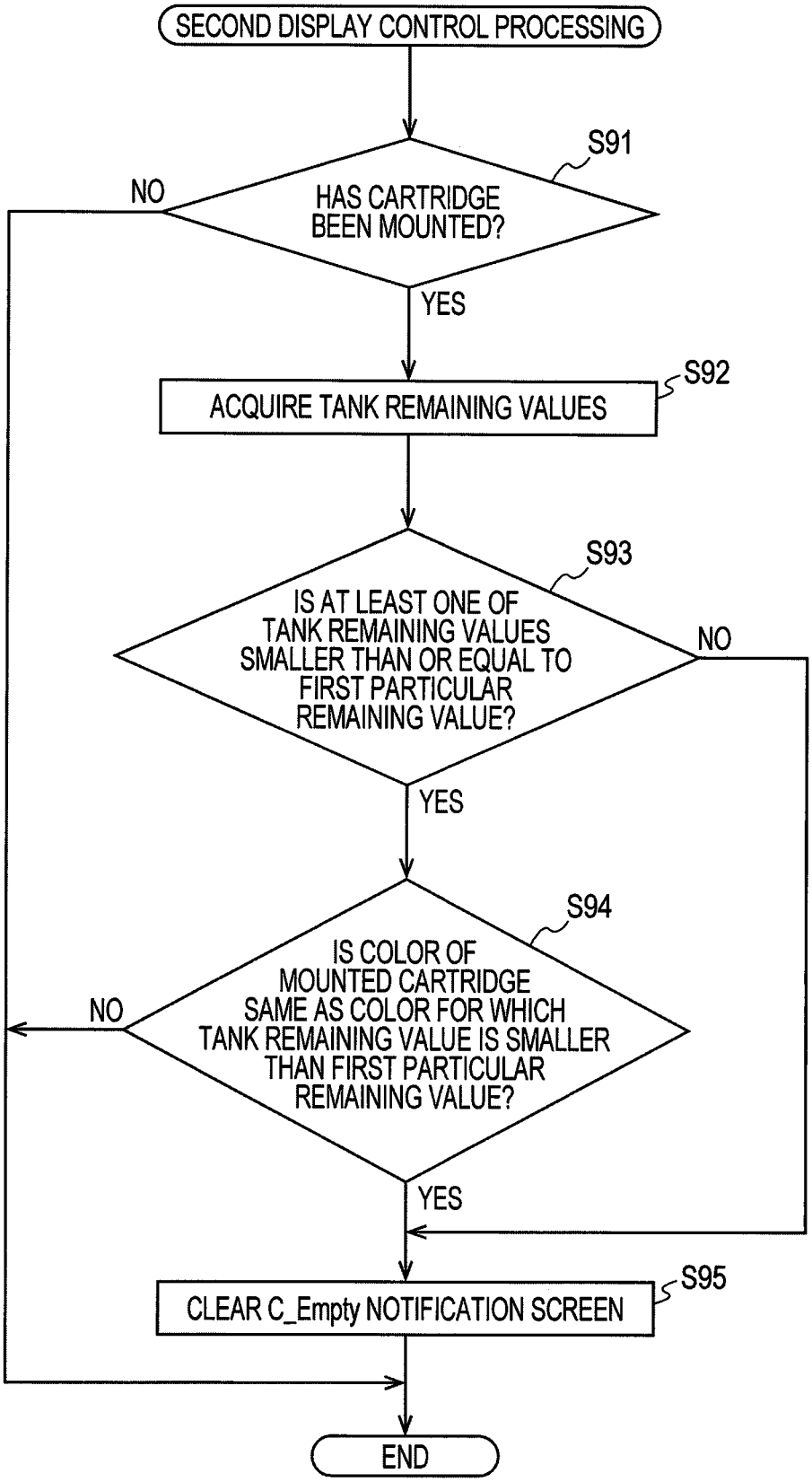
FIG. 9B is a flowchart of second display control processing.
Figure 10A:
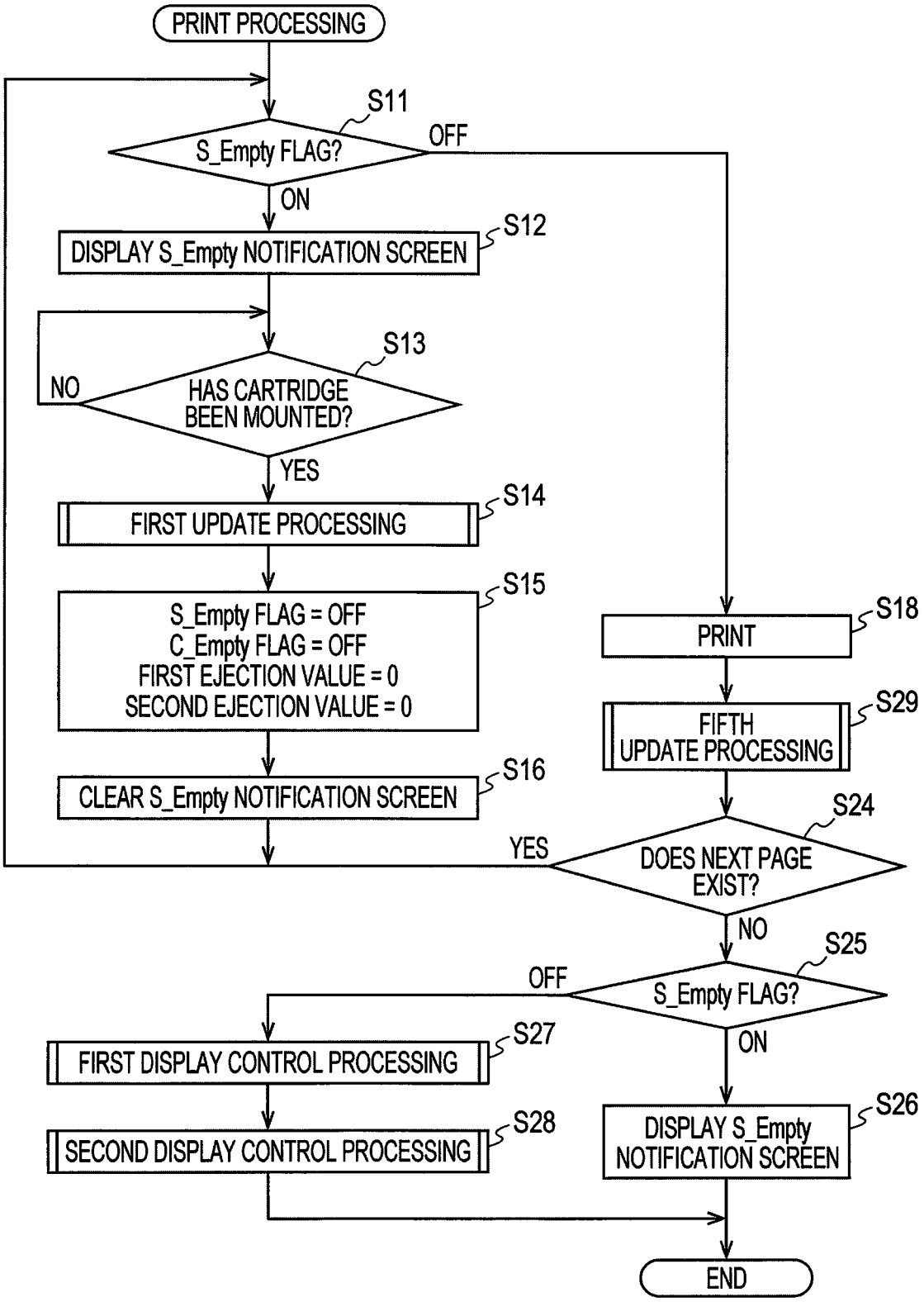
FIG. 10A is a flowchart of print processing according to a modification.
Figure 10B:
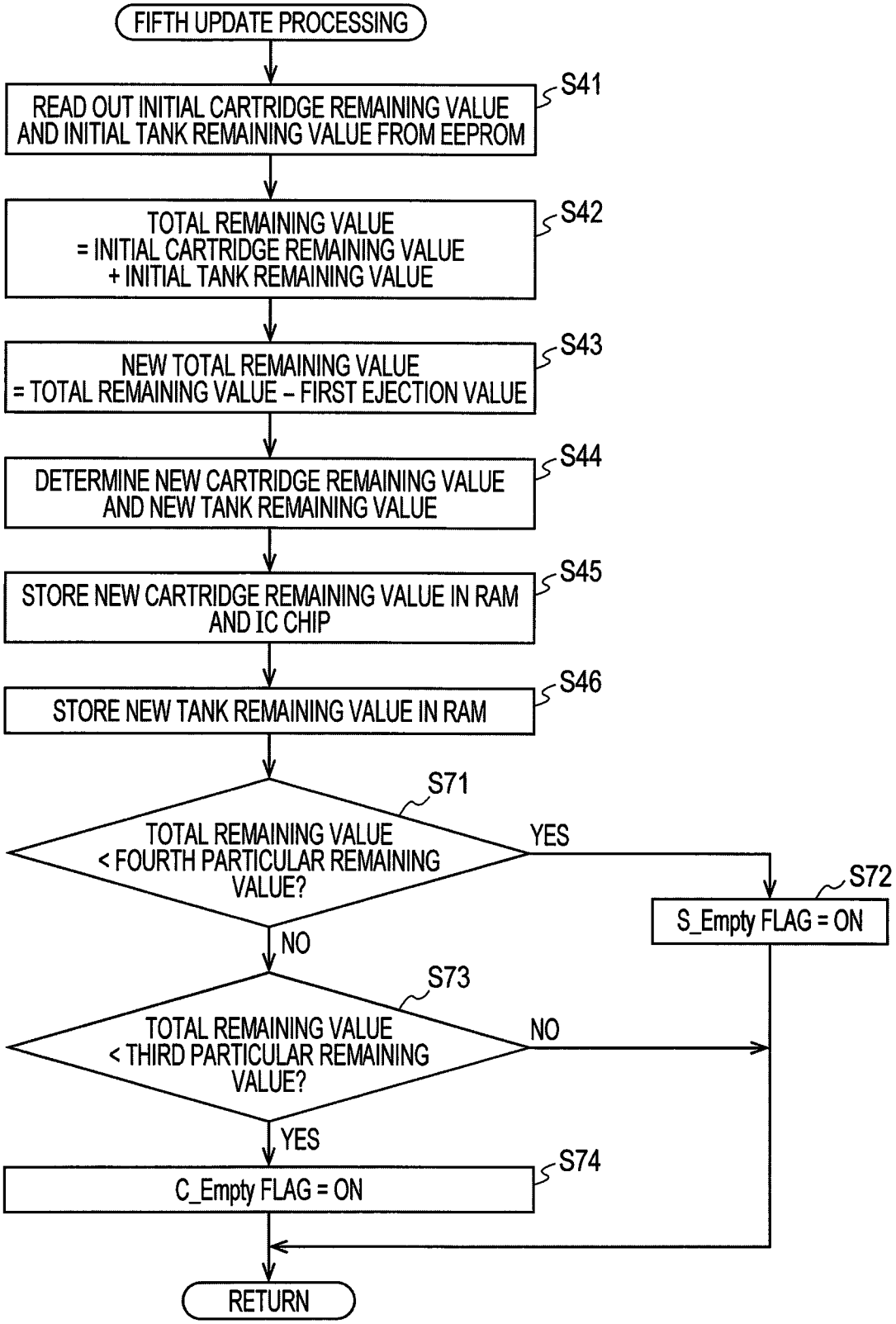
FIG. 10B is a flowchart of fifth update processing according to the modification.
Figure 11A:
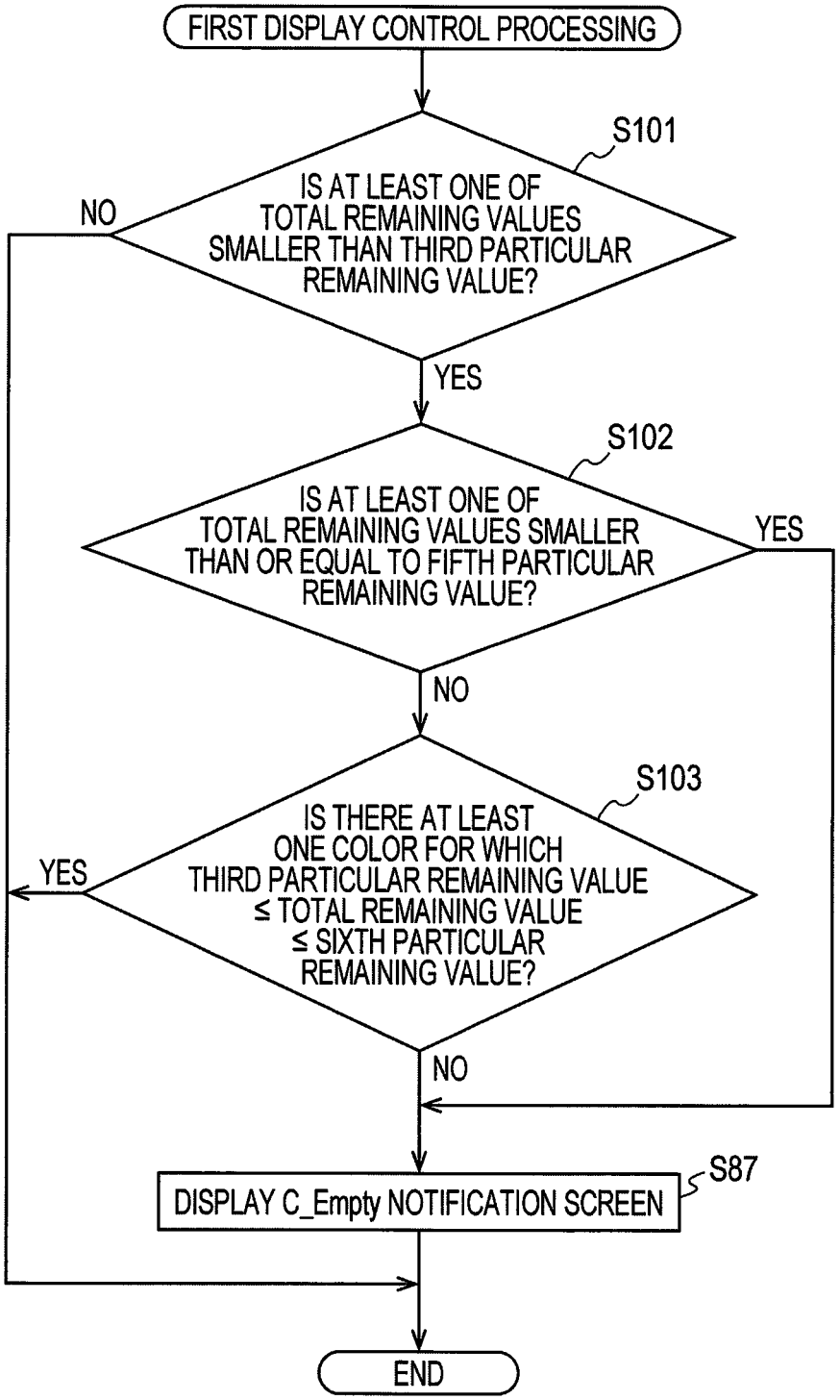
FIG. 11A is a flowchart of first display control processing according to the modification.
Figure 11B:
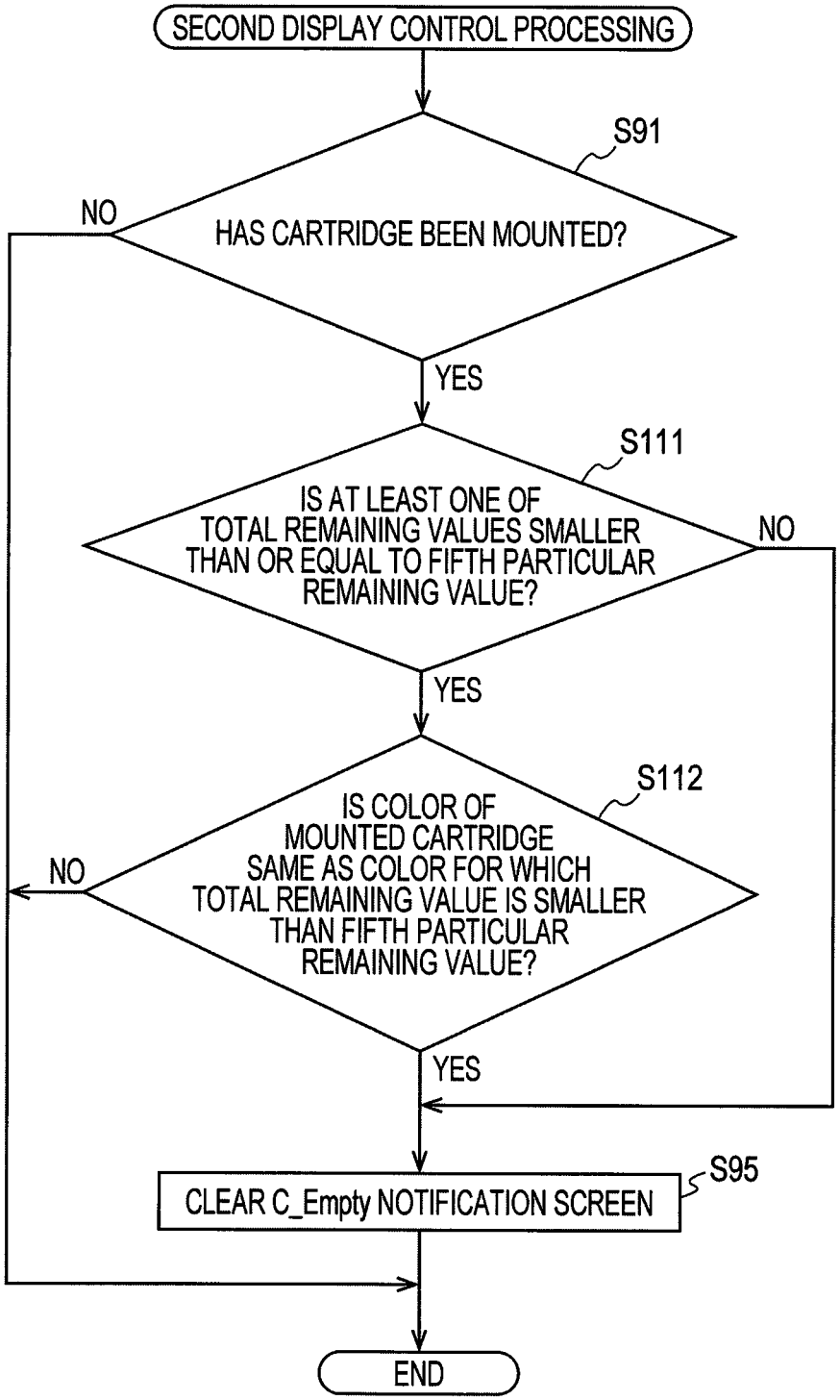
FIG. 11B is a flowchart of second display control processing according to the modification.

Unlike the above embodiment, in this modification, the controller 130 executes the print processing shown in FIG. 10A instead of the print processing shown in FIG. 7, and executes the first display control processing and the second display control processing shown in FIGS. 11A and 11B instead of the first display control processing and the second display control processing shown in FIGS. 9A and 9B. The processing other than the processing described below is the same as the processing described in the above embodiment. In the processing shown in FIGS. 10A, 10B, 11A and 11B, the same processing as those of the first embodiment are designated by the same reference numerals and the description thereof is omitted.

The controller 130 of the printer 10 according to this modification executes the print processing shown in FIG. 10A. The controller 130 executes the processing from S11 to S15 and the processing of S18 as in the embodiment. In response to determining in S11 that the value of the S_Empty flag in the EEPROM 61 is "OFF" (S11: OFF), the controller 130 executes the process in S18 and then executes the fifth update processing (S29).

The fifth update processing will be described with reference to FIG. 10B. The controller 130 executes the processing from S41 to S46 in the same manner as the second update processing (FIG. 8B) described in the embodiment. After executing S46, the controller 130 determines whether the new total remaining value calculated in S43 is smaller than a fourth particular remaining value (S71). The fourth particular remaining value is a theoretical value of the remaining amount of ink when the ink stored in the liquid chamber 171 of the tank 160 is used up, and is stored in the ROM 37 or the EEPROM 61 in advance. The remaining amount of ink in the liquid chamber 171 of the tank 160 when the total remaining value reaches the fourth particular remaining value is an example of a fourth liquid amount.

In response to determining that the new total remaining value calculated in S43 is smaller than the fourth particular remaining value (S71: Yes), the controller 130 stores "ON" in the S_Empty flag in the EEPROM 61 (S72), and ends the fifth update processing. In response to determining that the new total remaining value calculated in S43 is not smaller than the fourth particular remaining value (S71: No), the controller 130 determines whether the new total remaining value calculated in S43 is smaller than the third particular remaining value (S73).

The third particular remaining value is a theoretical value of the remaining amount of ink stored in the liquid chamber 171 of the tank 160 when the ink stored in the liquid chamber 210 of the cartridge 200 is used up. The third particular remaining value is stored in advance in the ROM 37 or the EEPROM 61. The remaining amount of ink in the liquid chamber 210 of the cartridge 200 when the total remaining value reaches the third particular remaining value is an example of a first liquid amount.

In response to determining that the new total remaining value calculated in S43 is not smaller than the third particular remaining value (S73: No), the controller 130 ends the fifth updating processing. In response to determining that the new total remaining value calculated in S43 is smaller than the third particular remaining value (S73: Yes), the controller 130 stores "ON" in the C_Empty flag in the EEPROM 61 (S74), and ends the fifth update processing.

First Display Control Processing

The controller 130 of the printer 10 according to the present modification executes the first display control processing shown in FIG. 11A.

First, with respect to the new total remaining value calculated in S43 of the fifth update processing, the controller 130 determines whether at least one of the four total remaining values of black, magenta, cyan, and yellow is smaller than the third particular remaining value (S101). In response to determining that all of the four new total remaining values calculated in S43 are larger than or equal to the third particular remaining value (S101: No), the controller 130 ends the first display control processing. The processing of S101 is an example of first determination processing. The remaining amount of ink in the liquid chamber 210 of the cartridge 200 when the new total remaining value calculated in S43 of the fifth update processing is the third particular remaining value is an example of a first liquid amount.

In response to determining that at least one of the four new total remaining values calculated in S43 is smaller than the third particular remaining value (S101: Yes), the controller 130 determines whether at least one of the total remaining values is smaller than or equal to a fifth particular remaining value (S102).

In response to determining in S102 that all four total remaining values are larger than the fifth particular remaining value (S102: No), the controller 130 determines whether there is at least one color for which the total remaining value is larger than or equal to the third particular remaining value and smaller than or equal to the sixth particular remaining value (S103).

The fifth particular remaining value is smaller than the third particular remaining value and larger than the fourth particular remaining value, and is stored in the ROM 37 or the EEPROM 61 in advance. For example, the fifth particular remaining value is set such that printing for twenty pages of image data can be performed after the total remaining value reaches the fifth particular remaining value and until the total remaining value reaches the fourth particular remaining value, or such that printing for two days can be performed during that period. The remaining amount of ink in the liquid chamber 171 of the tank 160 when the total remaining value reaches the fifth particular remaining value is an example of a third liquid amount.

In response to determining in S103 that there is at least one color for which the total remaining value is larger than or equal to the third particular remaining value and smaller than or equal to the sixth particular remaining value (S103: Yes), the controller 130 ends the first display control processing. The processing of S103 is an example of second determination processing.

The sixth particular remaining value is larger than the third particular remaining value, and is stored in advance in the ROM 37 or the EEPROM 61. For example, the sixth particular remaining value is set such that the time from when the total remaining value reaches the sixth particular remaining value until the total remaining value reaches the third particular remaining value is shorter than the time from when the total remaining value reaches the third particular remaining value until the total remaining value reaches the fifth particular remaining value.

In response to determining in S102 that at least one of the four total remaining values is smaller than or equal to the fifth particular remaining value (S102: Yes) or determining in S103 that there is no color for which the total remaining value is larger than or equal to the third particular remaining value and smaller than or equal to the sixth particular remaining value (S103: No), the controller 130 controls the display 28 to display the C_Empty notification screen (see FIG. 6B) indicating that the cartridge 200 should be replaced (S87), and ends the first display control processing.

Second Display Control Processing

The controller 130 of the printer 10 executes the second display control processing shown in FIG. 11B.

In response to determining that at least one of the four cartridges 200 is mounted (S91: Yes), the controller 130 determines whether at least one of the four new total remaining values calculated in S43 is smaller than or equal to the fifth particular remaining value (S111).

In response to determining that at least one of the four total remaining values is smaller than or equal to the fifth particular remaining value (S111: Yes), the controller 130 determines whether the color of the cartridge 200 determined to be mounted in S91 is the same as the color of the total remaining value determined to be smaller than the fifth particular remaining value in S111 (S112). In response to determining that the colors are not the same (S112: No), the controller 130 ends the second display control processing. The processing in S91 and S112 is an example of sixth determination processing.

In response to determining that all the total remaining values are larger than the fifth particular remaining value in S111 (S111: No) or determining that the colors are the same in S112 (S112: Yes), the controller 130 clears (deletes) the C_Empty notification screen displayed on the display 28 in S87 (S95), and ends the second display control processing.

In this modification, the controller 130 determines whether the new total remaining value calculated in S43 of the fifth update processing is smaller than the third particular remaining value in S101. In S103, the controller 130 determines whether the new total remaining value calculated in S43 of the fifth update processing is smaller than or equal to the sixth particular remaining value. The total remaining value is a value indicating the total remaining amount of ink. A cartridge remaining value indicating the amount of ink stored in the cartridge 200 is calculated or determined from the total remaining value. Thus, the total remaining value is a value corresponding to the amount of ink in the liquid chamber 210 of the cartridge 200. Thus, determining whether the total remaining value is smaller than the third particular remaining value is equivalent to determining whether the remaining amount of ink in the liquid chamber 210 of the cartridge 200 is smaller than a particular liquid amount (an example of a first liquid amount). Determining whether the total remaining value is smaller than or equal to the sixth particular remaining value is equivalent to determining whether the remaining amount of ink in the liquid chamber 210 of the cartridge 200 is smaller than a particular liquid amount (an example of a second liquid amount).

In the present modification, the controller 130 determines in S102 whether the new total remaining value calculated in S43 of the fifth update processing is smaller than or equal to the fifth particular remaining value. In S71, the controller 130 determines whether the new total remaining value calculated in S43 of the fifth update processing is smaller than or equal to the fourth particular remaining value. The total remaining value is a value indicating the total remaining amount of ink. A tank remaining value indicating the amount of ink stored in the tank 160 is calculated or determined from the total remaining value. Accordingly, the total remaining value is a value corresponding to the amount of ink in the liquid chamber 171 of the tank 160. Thus, determining whether the total remaining value is smaller than or equal to the fifth particular remaining value is equivalent to determining whether the remaining amount of ink in the liquid chamber 171 of the tank 160 is smaller than or equal to a particular liquid amount (an example of a third liquid amount). Determining whether the total remaining value is smaller than or equal to the fourth particular remaining value is equivalent to determining whether the remaining amount of ink in the liquid chamber 171 of the tank 160 is smaller than or equal to a particular liquid amount (an example of a fourth liquid amount).

Other Modifications

In the above-described example, ink flows out of the cartridge 200 into the tank 160 due to the head difference of ink. Alternatively, the ink may flow out from the cartridge 200 to the tank 160 by gravity, a pump, and so on. That is, the present disclosure may also be applied to a printer that supplies ink from the cartridge 200 to the tank 160 by gravity or a driving source.

In the above-described embodiment, the controller 130 detects whether the detected part 194 of the actuator 190 is in the first state or the second state based on the signal outputted from the liquid level sensor 33. However, as long as the ink level in the liquid chamber 171 can be detected, the configuration of the liquid level sensor 33 is not particularly limited. For example, the liquid level sensor 33 may be a sensor configured to optically detect the liquid level of the ink in the liquid chamber 171 by using a prism having a different reflectance depending on whether the ink is in contact with the rear wall 164 of the liquid chamber 171. Further, the liquid level sensor 33 may be an electrode rod inserted into the liquid chamber 171.

In the above description, the ink is described as an example of the liquid. However, for example, a pretreatment liquid ejected onto paper and so on prior to the ink at the time of printing may be stored in the cartridge. Alternatively, water for cleaning the head 21 may be stored in the cartridge.

The printer 10 described above may be used as part of a delivery system. The delivery system includes a printer 10 and an information collection server that collects information from one or more printers 10. The printer 10 and the information collection server are connected by a network such as the Internet. The printer 10 and the information collection server communicate with each other by using a communication protocol such as TCP/IP. In addition, the information collection server transmits information to a shipping server that accepts orders through a network. In response to determining that the liquid level signal from the liquid level sensor 33 is "H" (S82: Yes), the controller 130 of the printer 10 generates contact information for causing the information collection server to place an order for the cartridge 200, and send the contact information to the information collection server. The information collection server that has received the contact information transmits order information for ordering the cartridge 200 to the shipping server. The shipping server that has received the ordering information arranges the shipping of a new cartridge 200.

What is claimed is:

1. A liquid consumption apparatus comprising:

one or more mount case on which a plurality of cartridges is mounted, each of the plurality of cartridges having a first liquid chamber;

a plurality of tanks each having a second liquid chamber;

a plurality of liquid channels, each of the plurality of liquid channels having one end in communication with the second liquid chamber of one of the plurality of the tanks and another end in communication with the first liquid chamber of a corresponding one of the plurality of cartridges mounted on the one or more mount case;

a head having nozzles in communication with the second liquid chamber, the head being configured to eject liquid from the nozzles;

a display; and a controller configured to:

determine, for each of the plurality of cartridges, whether a remaining amount of liquid in the first liquid chamber is smaller than a first liquid amount;

in response to determining that a first cartridge exists in the plurality of cartridges, determine, for each cartridge other than the first cartridge among the plurality of cartridges, whether a remaining amount of liquid in the first liquid chamber is smaller than a second liquid amount, the first cartridge being a cartridge for which it is determined that the remaining amount is smaller than the first liquid amount, the second liquid amount being larger than the first liquid amount;

in response to determining that a second cartridge exists in the plurality of cartridges, determine whether a remaining amount of liquid in the first liquid chamber of the second cartridge is smaller than the first liquid amount, the second cartridge being a cartridge for which it is determined that the remaining amount is smaller than the second liquid amount; and in response to determining that a particular second cartridge exists, control the display to display a first screen including a first object that prompts replacement of the first cartridge and the particular second cartridge, the particular second cartridge being the second cartridge for which it is determined that the remaining amount is smaller than the first liquid amount.

2. The liquid consumption apparatus according to claim 1, wherein the controller is configured to:

display the first screen in response to determining that the remaining amount is smaller than the first liquid amount for all of one or a plurality of the second cartridge.

3. The liquid consumption apparatus according to claim 1, wherein the controller is configured to:

determine whether a remaining amount of liquid in the second liquid chamber in communication with the first liquid chamber of the first cartridge is smaller than a third liquid amount; and in response to determining that a third cartridge exists for which the remaining amount is smaller than the third liquid amount, control the display to display a second screen including a second object prompting replacement of the third cartridge and the first cartridge.

4. The liquid consumption apparatus according to claim 3, wherein the controller is configured to:

determine whether the remaining amount of liquid in the second liquid chamber in communication with the first liquid chamber of the third cartridge is smaller than a fourth liquid amount, the fourth liquid amount being smaller than the third liquid amount; and in response to determining that a particular third cartridge exists, prohibit ejection of liquid through the head, the particular third cartridge being the third cartridge for which the remaining amount is smaller than the fourth liquid amount.

5. The liquid consumption apparatus according to claim 3, wherein the controller is configured to:

after displaying the second screen, determine whether the third cartridge and the first cartridge are replaced;

in response to determining that the third cartridge is replaced, end displaying the second screen on the display; and in response to determining that the particular second cartridge exists, control the display to display a third screen including a third object prompting replacement of the particular second cartridge and a fourth cartridge that is the first cartridge determined not to have been replaced.

6. The liquid consumption apparatus according to claim 1, further comprising a liquid level sensor, wherein the controller is configured to:

receive a first signal outputted by the liquid level sensor when a position of a liquid surface in the second liquid chamber is higher than or equal to a particular position; and receive a second signal outputted by the liquid level sensor when the position of the liquid surface in the second liquid chamber is lower than the particular position; and wherein the determining whether the remaining amount of liquid in the first liquid chamber is smaller than the first liquid amount includes, in response to receiving the second signal, determining that the remaining amount of liquid in the first liquid chamber is smaller than the first liquid amount.

7. The liquid consumption apparatus according to claim 6, wherein the tank includes a detection object;

wherein the detection object is in a first state when the position of the liquid surface in the second liquid chamber is higher than or equal to the particular position;

wherein the detection object is in a second state different from the first state when the position of the liquid surface in the second liquid chamber is lower than the particular position; and wherein the liquid level sensor is configured to output the first signal in response to detecting the detection object in the first state and to output the second signal in response to detecting the detection object in the second state.

8. The liquid consumption apparatus according to claim 6, wherein the particular position is a same height as a liquid supply port through which liquid is supplied from the first liquid chamber to the second liquid chamber.

9. The liquid consumption apparatus according to claim 6, wherein the controller is configured to:

receive a signal outputted by the liquid level sensor;

perform liquid ejection;

receive a signal outputted by the liquid level sensor;

in response to determining that the signal received before the liquid ejection is the first signal and the signal received after the liquid ejection is the first signal, subtract a first ejection value from a total remaining value to calculate a new total remaining value, the total remaining value being a total of remaining amounts in the first liquid chamber and the second liquid chamber, the first ejection value being a cumulative value of an amount of liquid ejected by the head from mounting of the cartridge to present, and determine a new remaining amount in the first liquid chamber and a new remaining amount in the second liquid chamber by using a calculation formula or a table;

in response to determining that the signal received before the liquid ejection is the first signal and the signal received after the liquid ejection is the second signal, update the remaining amount in the first liquid chamber with zero, and update the remaining amount in the second liquid chamber with a predetermined amount; and in response to determining that the signal received before the liquid ejection is the second signal and the signal received after the liquid ejection is the second signal, subtract a second ejection value from the remaining amount in the second liquid chamber to calculate a new remaining amount in the second liquid chamber, the second ejection value being a cumulative value of an amount of liquid ejected by the head from when the signal acquired from the liquid level sensor changes from the first signal to the second signal to present, determine whether the second ejection value has reached a threshold value, and in response to determining that the second ejection value has reached the threshold value, prohibit ejection of liquid through the head.

10. The liquid consumption apparatus according to claim 1, wherein the controller is configured to:

in response to receiving an ejection instruction for ejecting liquid through the head, cause the head to eject liquid;

count an ejection amount of liquid instructed by the ejection instruction; and based on the counted ejection amount of liquid, calculate a remaining amount of liquid in the first liquid chamber and a remaining amount of liquid in the second liquid chamber.

11. The liquid consumption apparatus according to claim 1, wherein the first liquid amount in the first liquid chamber indicates a cartridge empty state.

* * * * *